US007601399B2

(12) United States Patent
Bamola et al.

(10) Patent No.: US 7,601,399 B2
(45) Date of Patent: Oct. 13, 2009

(54) HIGH DENSITY LOW PRESSURE PLASMA SPRAYED FOCAL TRACKS FOR X-RAY ANODES

(75) Inventors: Rajan Bamola, La Habra Heights, CA (US); Albert Sickinger, Irvine, CA (US)

(73) Assignee: Surface Modification Systems, Inc., Santa Fe Springs, CA (US)

( * ) Notice: Subject to any disclaimer, the term of this patent is extended or adjusted under 35 U.S.C. 154(b) by 240 days.

(21) Appl. No.: 11/803,295

(22) Filed: May 14, 2007

(65) Prior Publication Data

US 2008/0181366 A1 Jul. 31, 2008

Related U.S. Application Data

(60) Provisional application No. 60/898,800, filed on Jan. 31, 2007.

(51) Int. Cl.
*H05H 1/24* (2006.01)

(52) U.S. Cl. ..... 427/446; 427/576; 427/569

(58) Field of Classification Search ..... 427/446, 427/447, 576
See application file for complete search history.

(56) References Cited

U.S. PATENT DOCUMENTS

| | | | | |
|---|---|---|---|---|
| 3,839,618 | A | 10/1974 | Muehlberger | |
| 4,132,917 | A | 1/1979 | Bildstein et al. | |
| 4,224,273 | A | 9/1980 | Magendans et al. | |
| 4,328,257 | A | 5/1982 | Muehlberger et al. | |
| 4,534,993 | A | 8/1985 | Magendans et al. | |
| 5,943,389 | A | 8/1999 | Lee | |
| 6,113,991 | A * | 9/2000 | Salito | 427/455 |
| 6,120,854 | A * | 9/2000 | Clarke et al. | 427/447 |
| 6,132,812 | A | 10/2000 | Rodhammer et al. | |
| 6,296,043 | B1 * | 10/2001 | Bowen et al. | 164/46 |
| 6,390,876 | B2 | 5/2002 | Benz et al. | |
| 6,487,275 | B1 | 11/2002 | Baba et al. | |
| 6,584,172 | B2 | 6/2003 | Tiearney et al. | |

FOREIGN PATENT DOCUMENTS

GB 1464511 2/1977

OTHER PUBLICATIONS

Mark F. Smith; Laser Measurement of Particle Velocities in Vacuum Plasma Spray Deposition; 1st Plasma-Technik-Symposium; May 18-20, 1988; pp. 71-85; vol. I; USA.

WO 2008/094539; PCT/US2008/001149; International Search Report and the Written Opinion of the International Searching Authroity.

* cited by examiner

*Primary Examiner*—Timothy H Meeks
*Assistant Examiner*—Jimmy Lin
(74) *Attorney, Agent, or Firm*—Peter Ganjian

(57) ABSTRACT

This invention involves the application of dense, metallurgically bonded deposits of tungsten and tungsten rhenium coatings onto preformed based x-ray anodes to be used as focal tracks. The coatings are applied by low pressure DC plasma spraying. The invention also includes heat treatments that further densify the as-applied coatings improving their suitability for use as focal tracks.

37 Claims, 27 Drawing Sheets

A = 150 mm B = 250 mm C = 300 mm

A = 4 kPa B = 8 kPa C = 26 kPa

A = 88 kW

B = 93 kW

C = 100 kW

HIGH DENSITY LOW PRESSURE PLASMA SPRAYED FOCAL TRACKS FOR X-RAY ANODES

CROSS-REFERENCE TO RELATED APPLICATIONS

This Application claims the benefit of priority of prior U.S. Utility Provisional Patent Application No. 60/898,800, with a filing date of 31 Jan. 2007, the entire disclosure of which Application is expressly incorporated by reference in entirety herein.

BACKGROUND OF THE INVENTION (1) Field of the Invention

The present invention relates to medical diagnostic equipment and, more particularly, to a method for manufacture of a rotary anode for X-ray tubes using high-density low-pressure plasma sprayed focal track for X-ray anodes, and the rotary anode produced.

(2) Description of Related Art

Conventional methods or processes of manufacturing a rotary anode for x-ray tubes and the anode produced are well known. For example, the U.S. Pat. No. 4,534,993 to Magendans et al. teaches a conventional method or process of manufacturing a rotary anode for x-ray tubes and the anode produced using conventional plasma spraying of coating material for the focal track onto a base unit of the anode to produce the target layer of the anode. The entire disclosure of the U.S. Pat. No. 4,534,993 to Magendans et al., issued Aug. 13, 1985 is expressly incorporated herein by this reference. Magendans et al. teaches a method of applying deposit material for the target layer onto the anode body using moderate-pressure plasma spraying techniques. However, attempts to duplicate results by those skilled in the art have not been successful, especially for larger diameter anodes.

U.S. Pat. No. 4,534,993 to Magendans et al. observed the difficulty in obtaining well-heated tungsten particles at chamber pressure less than one-half the atmospheres and, accordingly, Magendans et al. teach the use of chamber pressures between 30 kilopascals to 50 kilopascals to allow for adequate heating of tungsten particles. Of course, at these higher chamber pressures, only subsonic to sonic plasma flow velocities are created, which reduce the velocity and the momentum, and hence, the impact of the tungsten particles impinging onto the focal track to produce the target layer. As was postulated by Mark Smith, in the first Plasma-Technik Symposium, Lucerne/Switzerland, May 18-20, 1988, vol. 1, pp 77 to 85 ("Mark Smith"), this lower velocity of the particles reduce the packing density of the resulting target layer. In other words, the higher chamber pressures increased the drag forces on the tungsten particles, which lowered their velocity, which in turn, lowered their packing density in forming the focal track structure. Of course, one of the main reasons for slowing the velocity of the tungsten particles in U.S. Pat. No. 4,534,993 to Magendans et al is to allot the tungsten particles sufficient time to melt, before their impact with the base element. The allocation of sufficient time to melt the particles in the Magendans et al reference is required because of the very large differences in the tungsten particle sizes used. The particles used in the U.S. Pat. No. 4,534,993 to Magendans et al. have a grain size that range from 5 to 45 micrometers (40 micrometers difference in grain sizes), and more narrowly, defined within the range 10 to 37 micrometers (27 micrometers difference in grain sizes), which still constitutes very large mass differences. Given the large mass differences, the smaller tungsten particles (e.g., 5 micrometers) melt faster than the larger particles (e.g., 45 micrometers). Accordingly, sufficient time is required to allow the larger particle sizes to melt, and hence the need for reduction in their velocity, and the requirement for the high-pressure chamber.

The use of particles with large mass differences between particle sizes bring about another disadvantage. This large differences in particle sizes of the tungsten or tungsten alloy particles cause wide range of thermal histories and velocities between each particle, which lead to structures having multitude of defects such as re-solidified and un-melted particles entrapped between splats, which result in high levels of porosity of the focal track. Accordingly, in spite of intensive development efforts around the world in recent years, the focal track coatings using conventional plasma spraying taught by the U.S. Pat. No. 4,534,993 to Magendans et al. has not be successful. As with Mark Smith, the U.S. Pat. No. 6,132,812 to Rodhammer et al. recognized deficiencies in the teaching of the U.S. Pat. No. 4,534,993 to Magendans et al., and moved to teaching a new variant of the plasma spraying, the so-called inductive vacuum plasma spraying, which has its own set of deficiencies.

One of the deficiencies of the U.S. Pat. No. 6,132,812 to Rodhammer et al. is that it has a low feed rate of the tungsten or tungsten alloy particles, which leads to higher process or production time. The application of the U.S. Pat. No. 6,132,812 to Rodhammer et al. was limited to only 120 mm targets, and maintained the substrate temperatures by low rotation rate of the main body, which is at 10 revolutions per minute, when depositing the target layer. However, slow rotational rates for larger diameter targets will lead to conductive and irradiative losses of heat. That is, as one section of the target is heated while the target slowly rotates, the diagonally opposite section of the same away from the heat source cools, and hence, for larger targets slow rotation of the target will not function to allow even or uniform temperature for the entire target. A further disadvantage with Rodhammer et al. is the use of columnar grain structure. The columnar grain structures have a possibility of longer cracks along columnar grain boundaries.

Regrettably, both the U.S. Pat. No. 4,534,993 to Magendans et al. and the U.S. Pat. No. 6,132,812 to Rodhammer et al. lack the teaching and method for maintaining a substantially uniform temperature for the recently developed larger diameter anode bodies. Reference is made to other few, exemplary U.S. patents that also teach conventional methods or processes of manufacturing a rotary anode for x-ray tubes and the anode produced: U.S. Pat. Nos. 4,132,917; 4,224,273; 4,328,257; 5,943,389; 6,390,876; 6,487,275; and 6,584,172. Unfortunately, most prior art conventional plasma spraying methods of manufacturing a rotary anode for x-ray tubes suffer from obvious disadvantages, one non-limiting example of which is in terms of thermal management of the application of materials that produce a focal track of the anode.

In light of the current state of the art and the drawbacks to current methods of manufacturing a rotary anode for x-ray tubes mentioned above, a need exists for a method of manufacturing a rotary anode for x-ray tubes that would consider thermal management of the whole anode from conception to provide homogenously high-density focal track, and that would withstand higher energy electron bombardment then currently possible.

BRIEF SUMMARY OF THE INVENTION

One aspect of the present invention provides a method for the production of a rotary anode for X-ray tubes, comprising:

providing a base;

using low pressure plasma to spay material as a focal track layer on to the base, including use of at least one plasma gun and one or more auxiliary heating sources.

One optional aspect of the present invention provides a method for production of a rotary anode for X-ray tubes, wherein:

the material is comprised of tungsten and tungsten alloys.

Another optional aspect of the present invention provides a method for production of a rotary anode for X-ray tubes, wherein:

tungsten alloy is comprised of tungsten rhenium alloys comprising of rhenium from 3.5 wt % up to a solubility limit in the tungsten.

Yet another optional aspect of the present invention provides a method for production of a rotary anode for X-ray tubes, wherein: the rhenium content is 5 to 10 wt %.

Still another optional aspect of the present invention provides a method for production of a rotary anode for X-ray tubes, wherein:

the tungsten and the tungsten alloy are comprised of a de-agglomerated tungsten powder, with a mean powder particle size ranging form approximately 7 micrometers to about 12 micrometers or less, with a narrow particle size distribution of approximately 2 to 15 micrometers or less.

A further optional aspect of the present invention provides a method for production of a rotary anode for X-ray tubes, wherein:

the one or more auxiliary heating sources are comprised of plasma guns.

Still a further optional aspect of the present invention provides a method for production of a rotary anode for X-ray tubes, wherein:

the low pressure plasma spraying of tungsten alloy as a focal track layer onto the base is comprised of:

placing the base within a chamber;

masking areas of the base adjacent the focal track to shield the areas from tungsten alloy spray deposits;

a first lowering of the chamber pressure for removal of gases;

introducing at low pressure inert gas into the chamber for forming a protective environment;

igniting the plasma guns inside the chamber;

cleaning the base for removal of oxides and dirt;

further de-agglomerating the de-agglomerated tungsten alloy powder;

preheating the base for commencing a low pressure plasma spraying coating cycle;

pouring the further de-agglomerated tungsten alloy powder into one of the plasma guns for depositing thereof onto the base;

commencing the low pressure plasma spraying coating cycle of the base to desired coating thickness using one of the plasma guns, and maintaining even heating of the base using one of other plasma gun and heat source;

a second lowering of the chamber pressure upon completion of the low pressure plasma spraying coating cycle, cooling the base, filling the chamber with gas to atmospheric pressure, and removing the base.

Another optional aspect of the present invention provides a method for production of a rotary anode for X-ray tubes, wherein:

the base is placed onto a self-aligning fixture that aligns the base with an axial centerline of a turntable that is located within the chamber, with the turntable effecting an axial rotation and translational movement of the base via computer control within the chamber.

Still another optional aspect of the present invention provides a method for production of a rotary anode for X-ray tubes, wherein:

the self-aligning fixture is comprised of high temperature molybdenum alloys, having three independent components locked and centered by the use of molybdenum eccentric pin that lock in the base alloy thereon, and align base with the central axis of the turntable;

the turntable is comprised of an insulating platform allowing the base to rest thereon, and preventing heat conduction from the anode into the turntable; and the rotation is effected by a drive mechanism, and the axial translation is effected by servo control of a shaft that moves turntable.

Yet another optional aspect of the present invention provides a method for production of a rotary anode for X-ray tubes, wherein:

the mask is coupled with the self-aligning fixture by a locking mechanism for quickly and easily locking and releasing the base and preventing the base from wobbling when locked.

A further optional aspect of the present invention provides a method for production of a rotary anode for X-ray tubes, wherein:

a movement of the plasma guns inside the chamber is vertical in relation to the base.

Still a further optional aspect of the present invention provides a method for production of a rotary anode for X-ray tubes, wherein:

the control of pressure of the chamber, motion of the plasma guns, and a rotary and translational axis of the base alloy are controlled by a computer.

Yet a further optional aspect of the present invention provides a method for production of a rotary anode for X-ray tubes, wherein:

the first lowering of the chamber pressure is reduced to approximately 400 micrometers and lower to reduce residual reactive gasses within the chamber to a negligible levels.

Another optional aspect of the present invention provides a method for production of a rotary anode for X-ray tubes, wherein:

the inert gases introduced into the chamber are comprised of argon and helium, and is set to increase the chamber pressure to an approximate pressure of 5 to 60 torr.

Yet another optional aspect of the present invention provides a method for production of a rotary anode for X-ray tubes, wherein:

the cleaning of the base includes using negative reverse transferred arc using one or more plasma guns.

Still another optional aspect of the present invention provides a method for production of a rotary anode for X-ray tubes, wherein:

negative reverse transferred arc further comprises:

providing a supplemental power supply coupled with at least one of the plasma guns to form a bias from an anode of the selected plasma gun to the base alloy, which when ignited, creates arcing and removes and pulls off surface oxides and dirt from a surface of the base.

A further optional aspect of the present invention provides a method for production of a rotary anode for X-ray tubes, wherein:

a duration of cleaning lasts approximately from about 60 to 90 seconds, with a power input of approximately 20 KW.

Still a further optional aspect of the present invention provides a method for production of a rotary anode for X-ray tubes, wherein:

further de-agglomerating process, includes:

heating the de-agglomerated tungsten alloy powder to an approximate temperature of about 38° C. to remove moisture by placing.

Another optional aspect of the present invention provides a method for production of a rotary anode for X-ray tubes, wherein:

further de-agglomerating process, includes:

vibrating the de-agglomerated tungsten alloy powder for time to eliminate electrostatic charges, preventing static agglomeration of the particles.

Still another optional aspect of the present invention provides a method for production of a rotary anode for X-ray tubes, wherein:

the duration of preheating the base to a minimum of 1300° C. and higher is approximately 3 to about 4 minutes, which allows for re-crystallization of equiaxed grain of the tungsten alloy particles deposited onto the base as the focal track using the plasma guns.

Yet another optional aspect of the present invention provides a method for production of a rotary anode for X-ray tubes, wherein:

the duration of the coating cycle is approximately 16 minutes, and is comprised of moving the base under the plasma guns through the rotational and translational motion of the base.

A further optional aspect of the present invention provides a method for production of a rotary anode for X-ray tubes, wherein:

the second lowering of the chamber pressure reduces the chamber pressure back to 400 microns and lower.

Still a further optional aspect of the present invention provides a method for production of a rotary anode for X-ray tubes, wherein:

the base is cooled to an approximate temperature of about 150° C.

Another optional aspect of the present invention provides a method for production of a rotary anode for X-ray tubes, wherein:

cooling the base includes using a cooling chamber, with the cooling chamber filled with an inert gas and the base moved therein for faster cooling.

Yet another optional aspect of the present invention provides a method for production of a rotary anode for X-ray tubes, wherein:

the inert gas is comprised of argon.

A further optional aspect of the present invention provides a method for production of a rotary anode for X-ray tubes, wherein:

a post-coating heat treatment to stabilize grain structure and provide relief of residual stress.

Still a further optional aspect of the present invention provides a method for production of a rotary anode for X-ray tubes, wherein:

post-coating heat treatment includes:

placing the formed anode within a vacuum chamber and reducing a pressure of the vacuum chamber to de-gas the formed anode, and commencing a heat treatment process of the formed anode therein within the vacuum chamber, which allows the void pores therein the focal track to consolidate.

Another optional aspect of the present invention provides a method for production of a rotary anode for X-ray tubes, wherein:

the vacuum chamber is a vacuum heat treatment furnace.

Yet another optional aspect of the present invention provides a method for production of a rotary anode for X-ray tubes, wherein:

the pressure of the vacuum chamber is reduce to approximately $10^{-5}$-10−6 micrometers or less.

Still another optional aspect of the present invention provides a method for production of a rotary anode for X-ray tubes, wherein:

the duration and intensity of the heat treatment is approximately 30 minutes to 2 hours at an approximately temperature of 1600° C., which further dense the focal track by an additional 1 to 1.5% of as sprayed density.

A further optional aspect of the present invention provides a method for production of a rotary anode for X-ray tubes, wherein:

further densification of the formed anode by commencing one of hot isostatic pressing, hot forging, and pseudo hot isostatic pressing of the anode.

Still a further optional aspect of the present invention provides a method for production of a rotary anode for X-ray tubes, wherein:

the hot isostatic pressing includes:

heat treatment of the formed anode under an increased chamber pressure by introducing an inert gas therein while maintain the heat treatment process.

Yet a further optional aspect of the present invention provides a method for production of a rotary anode for X-ray tubes, wherein:

the inert gas is comprised of argon to form a protective environment, with the duration of the hot isostatic pressing lasting from approximately 1 to about 2 hours, under approximate pressure of about 15,000 psi to 28,000 psi, at a temperature of approximately 1500° C. to 1800° C., which results in an anode having a theoretical density of 98% of theoretical and upwards.

Another optional aspect of the present invention provides a method for production of a rotary anode for X-ray tubes, wherein:

grinding the focal track layer using diamond grinding wheel to form an appropriate angle of focal track layer; and application of a super finishing process using diamond belts to achieve finishes of approximately 4 micro-inches and less.

Yet another optional aspect of the present invention provides a method for production of a rotary anode for X-ray tubes, wherein:

the super finish process includes vibratory polishing the grinded-off anode to polish off the grind marks.

Still another optional aspect of the present invention provides a method for production of a rotary anode for X-ray tubes, wherein:

the particle velocity is approximately 200 m/sec or more within the plasma flow prior to impingement onto the base.

A further optional aspect of the present invention provides a method for production of a rotary anode for X-ray tubes, wherein:

the pressure within the chamber is modified by pumps.

Still a further optional aspect of the present invention provides a method for production of a rotary anode for X-ray tubes, wherein:

the base is comprised of an alloy with primary constituent comprised of molybdenum.

Yet a further optional aspect of the present invention provides a method for production of a rotary anode for X-ray tubes, wherein:

the base alloy is comprised of one of Titanium-Zirconium-Molybdenum (TZM) alloy, Oxide dispersion strengthen Molybdenum alloy, Carbide dispersion strengthen Molybdenum alloy, Boride dispersion strengthen Molybdenum, and Niobium-tungsten Molybdenum alloy.

Another optional aspect of the present invention provides a method for production of a rotary anode for X-ray tubes, wherein:

the base alloyis manufactured using one of a powder metallurgical techniques and arc melting, followed by one of forging and rolling.

Another aspect of the present invention provides rotary anode for X-ray tubes, comprising:

a base;

material sprayed onto the base as a focal track using low pressure plasma spraying having at least one plasma gun and one or more auxiliary heating sources.

Another optional aspect of the present invention provides rotary anode for X-ray tubes, wherein:

the material is comprised of tungsten and tungsten alloy.

Still another optional aspect of the present invention provides rotary anode for X-ray tubes, wherein:

tungsten alloy is comprised of tungsten rhenium alloys comprising of rhenium from 3.5 wt % up to a solubility limit in the tungsten.

Still another optional aspect of the present invention provides rotary anode for X-ray tubes, wherein:

the rhenium content is 5 to 10 wt %.

Yet another optional aspect of the present invention provides rotary anode for X-ray tubes, wherein:

the tungsten and the tungsten alloy are comprised of a de-agglomerated tungsten powder, with a mean powder particle size ranging form approximately 2 micrometers to about 15 micrometers, with a $D_{50}$ of 8 to 10 micrometers.

A further optional aspect of the present invention provides rotary anode for X-ray tubes, wherein:

the focal track has a theoretical density of 98% upwards.

Still a further optional aspect of the present invention provides rotary anode for X-ray tubes, wherein:

the one or more auxiliary heating sources are comprised of plasma guns.

Another optional aspect of the present invention provides rotary anode for X-ray tubes, wherein:

the base is comprised of an alloy with primary constituent comprised of molybdenum.

Yet another optional aspect of the present invention provides rotary anode for X-ray tubes, wherein:

the base alloy is comprised of one of Titanium-Zirconium-Molybdenum (TZM) alloy, Oxide dispersion strengthen Molybdenum alloy, Carbide dispersion strengthen Molybdenum alloy, Boride dispersion strengthen Molybdenum, and Niobium-tungsten Molybdenum alloy.

Still another optional aspect of the present invention provides rotary anode for X-ray tubes, wherein:

the base alloy is manufactured using one of a powder metallurgical techniques and arc melting, followed by one of forging and rolling.

These and other features, aspects, and advantages of the invention will be apparent to those skilled in the art from the following detailed description of preferred non-limiting exemplary embodiments, taken together with the drawings and the claims that follow.

BRIEF DESCRIPTION OF THE DRAWINGS

It is to be understood that the drawings are to be used for the purposes of exemplary illustration only and not as a definition of the limits of the invention. Throughout the disclosure, the word "exemplary" is used exclusively to mean "serving as an example, instance, or illustration." Any embodiment described as "exemplary" is not necessarily to be construed as preferred or advantageous over other embodiments.

Referring to the drawings in which like reference character(s) present corresponding part(s) throughout.

DETAILED DESCRIPTION OF THE INVENTION

The detailed description set forth below in connection with the appended drawings is intended as a description of presently preferred embodiments of the invention and is not intended to represent the only forms in which the present invention may be constructed and or utilized.

For purposes of illustration, programs and other executable program components are illustrated herein as discrete blocks, although it is recognized that such programs and components may reside at various times in different storage components, and are executed by the data processor(s) of the computers.

Figure 1A:
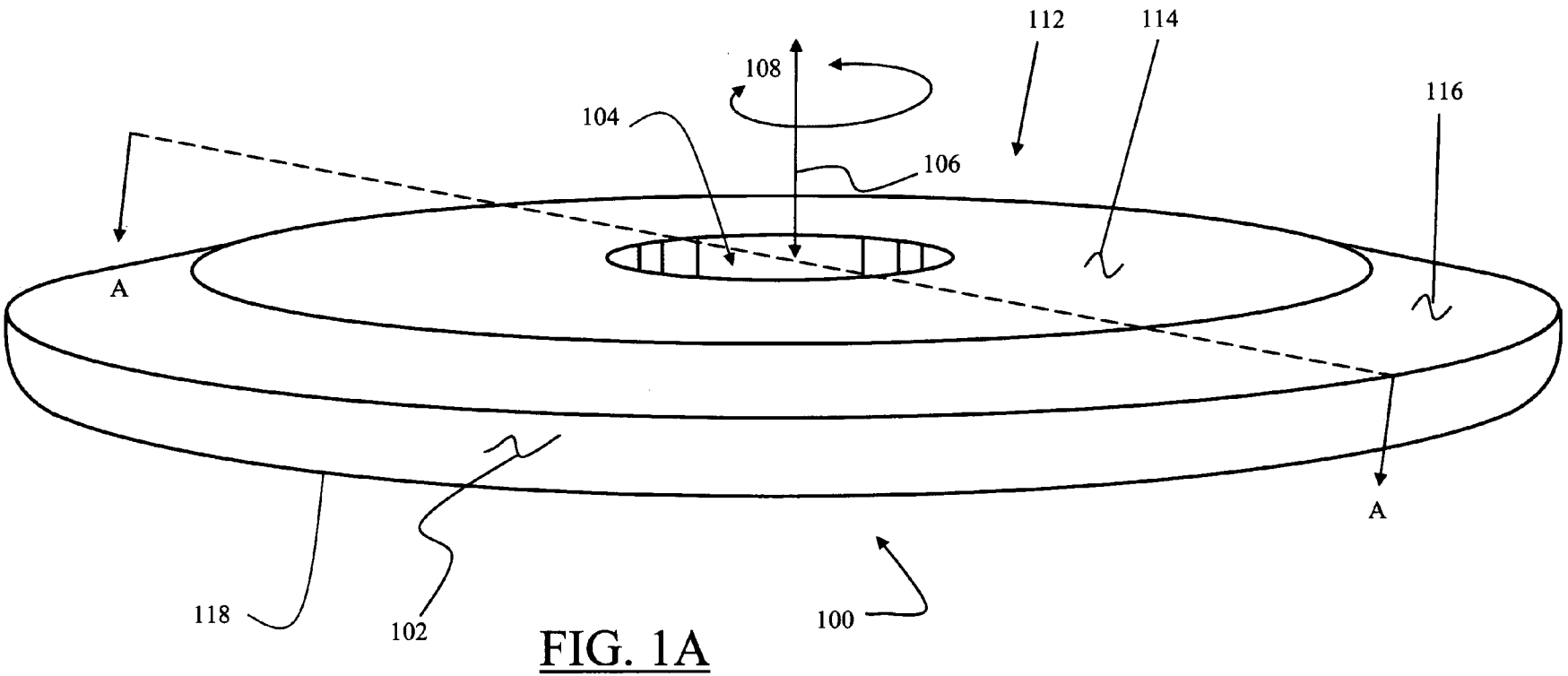
FIG. 1A is an exemplary perspective illustration of a front side of a base in accordance with the present invention.
Figure 1B:
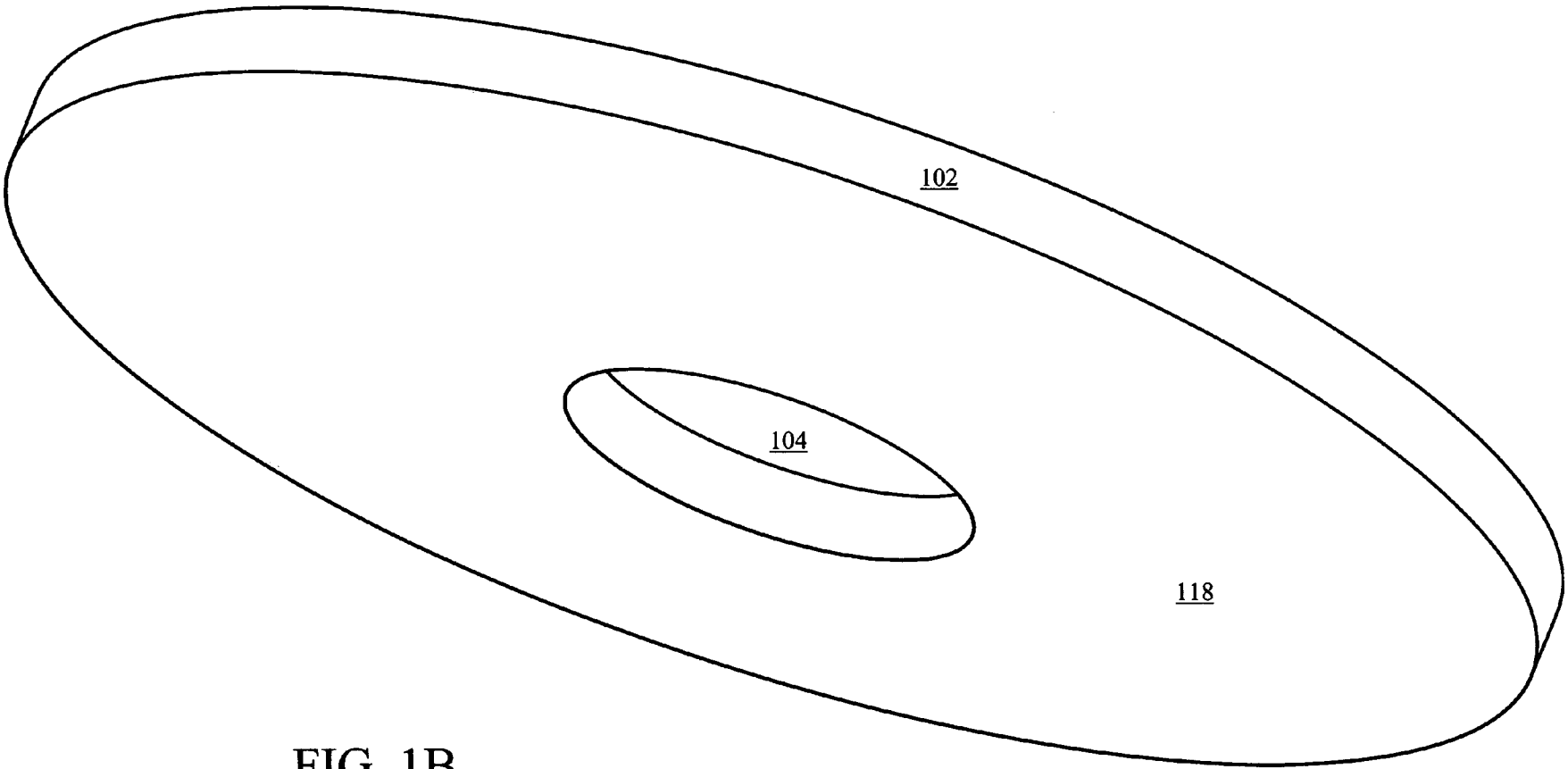
FIG. 1B is an exemplary perspective illustration of a back side of the base illustrated in FIG. 1A in accordance with the present invention.

X-ray tubes with rotating anodes are used to generate x-rays for medical imaging devices. FIG. 1A is an exemplary perspective view of a base 100 in accordance with the present invention that is shaped as a disc, and generally used as a substrate of a rotary anode. In general, the base 100 is comprised of a circular disc of varying thickness or density with rounded rims or edges 102 at its distal ends, and a circular central hole 104 at its center. The base 100 includes the central hole 104 along its axis of rotation 106, which is longitudinal transverse the diameter length of the base 100. The base 100 is secured within the anode tube (e.g., to a stem) through the central hole 104, and rotates about the axial rotation 106 during operation of the imaging device in either direction indicated by the arrow 108. The front lateral face or radial plane 112 of the base 100 is generally flat at a proximal end 114 from its radial center axis 106, and radially beveled or slanted at a distal end 116 thereof, at an approximate angle of about 7°. Stated otherwise, the base 100 along its radial longitudinal distal ends 116 is beveled or sloped radially downward towards the rounded rims or edges 102. The frontal lateral face or the radial plane 112, its oblique radial distal end surface 116, and the rounded rims or edges 102 are uniform, contiguous, and integral part of base 100, forming a single unitary piece. In general, as illustrated in FIG. 1B, the rear lateral face or radial plane 118 of the base 100 is substantially flat. However, other configurations are very much possible, including the rear lateral face 118 being the mirror image of the frontal lateral face 112.

In general, the base 100 is comprised of molybdenum alloys, non-limiting examples of which may include one of Titanium-Zirconium-Molybdenum (TZM) alloy, Oxide dispersion strengthen Molybdenum alloy, Carbide dispersion strengthen Molybdenum alloy, Boride dispersion strengthen Molybdenum, and Niobium-tungsten Molybdenum alloy. Non-limiting examples for manufacturing the base 102 may include using one of a powder metallurgical techniques and arc melting, followed by one of forging and rolling, all of which are well known. Although not illustrated, it should be noted and appreciated by those skilled in the art that the techniques disclosed by the present invention are equally applicable to soft X-ray targets requiring X-ray emissive layers on the outer periphery of discs.

Figure 2:
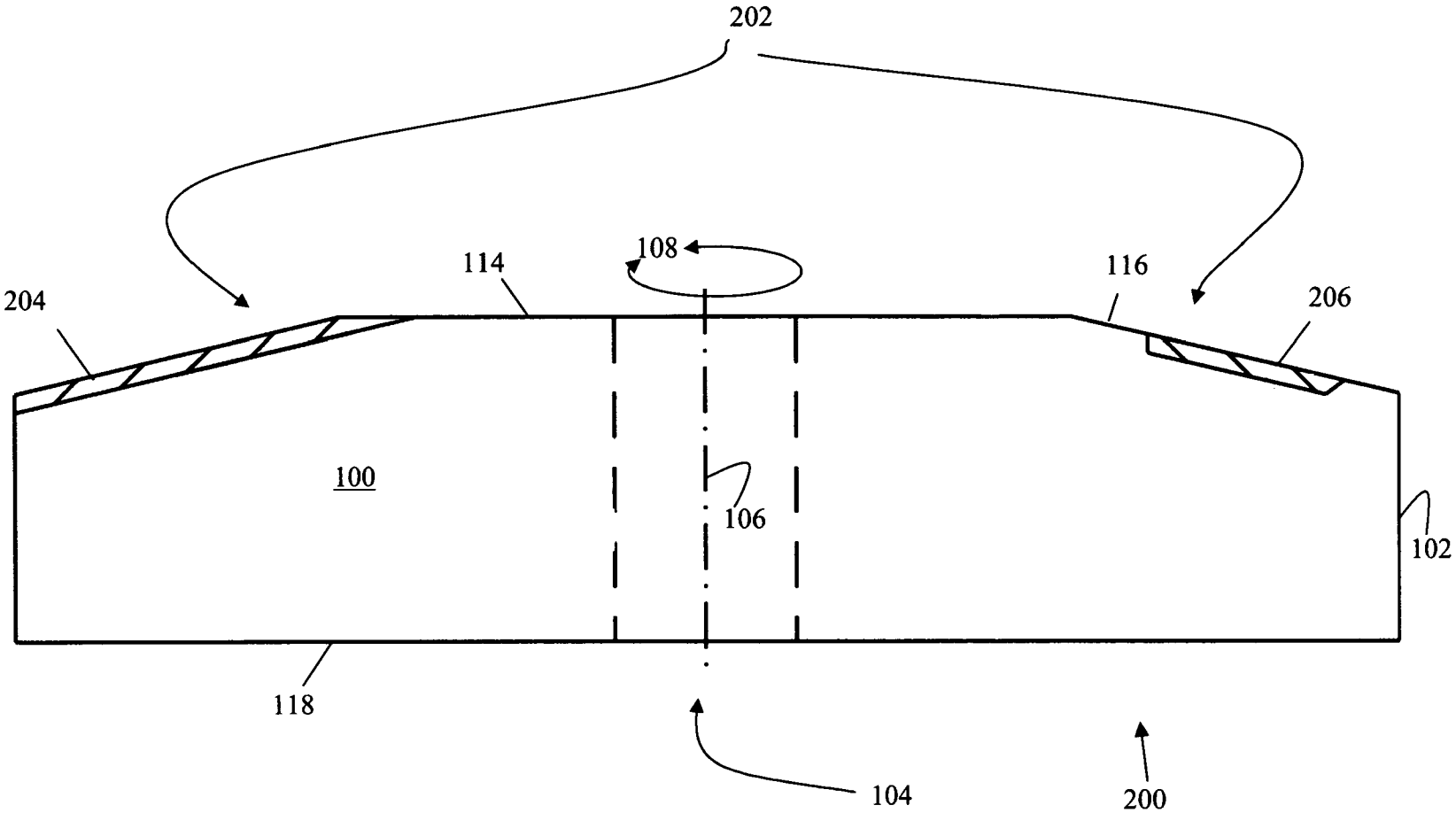
FIG. 2 is an exemplary perspective cross-sectional view of a rotating anode in accordance with the present invention, which uses the base illustrated in FIG. 1A.

FIG. 2 is an exemplary perspective cross-sectional view of a rotating anode 200 in accordance with the present invention, which uses the base 100 illustrated in FIG. 1A. The anode 200 is illustrated with the cut-out section of the base 100 along the indicated plane A-A shown in FIG. 1A. As illustrated in FIG. 2, the rotary anode 200 includes a focal track layer 202, where X-rays are created by bombarding the focal track layer 202 with electrons. The methods, techniques, and the application of applying the focal track layer 202 in accordance with the present invention may be used to directly apply the focal track layer 202 onto the base 100 as shown by the area marked 204. The methods, techniques, and the application of applying the focal track layer 202 in accordance with the present invention may also be used to apply the focal track layer 202 into a recess cut (radial along the frontal radial plane) into the base 100 as shown by the area marked 206. As indicated in FIG. 2, the focal track layer 202 (recessed or not) is located along the radially beveled or slanted section 116 of the base 100.

Figure 3:
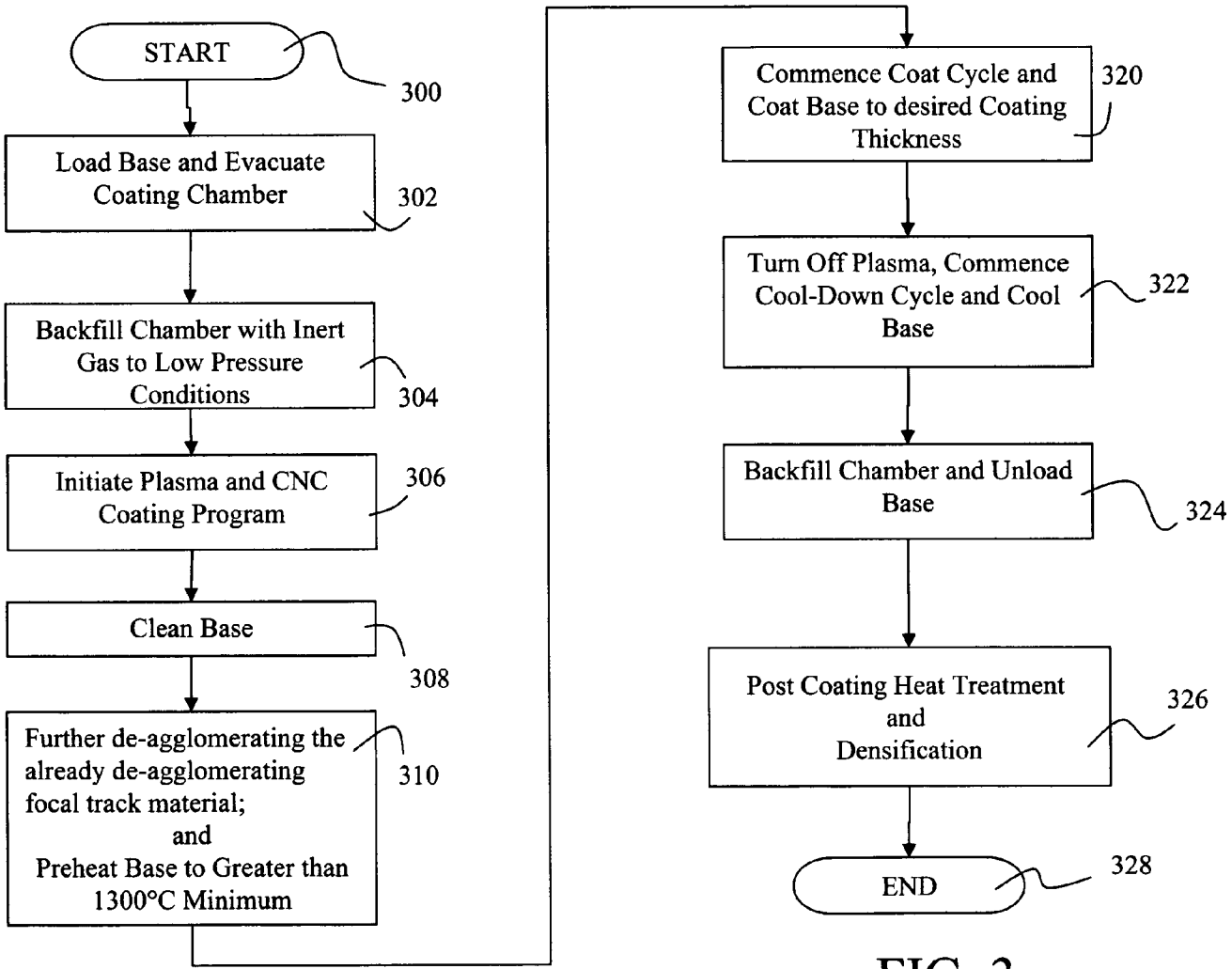
FIG. 3 is an exemplary flow chart that illustrates the various functional acts required by the method for production of the rotary anode in accordance with the present invention.

The present invention provides a method for the production of the rotary anode 200 for X-ray tubes, comprising the base 100, using Low Pressure Plasma Spaying (LPPS) to spray material as a focal track layer 202 onto the base 100, including use of at least one plasma gun and one or more auxiliary heating sources. FIG. 3 is an exemplary flow chart that illustrates the various functional acts required by the method for production of the rotary anode 202 in accordance with the present invention. FIGS. 4 to 17 are exemplary illustrations of equipment used for performing the functional acts for the production of rotary anodes in accordance with the present invention.

Figure 4:
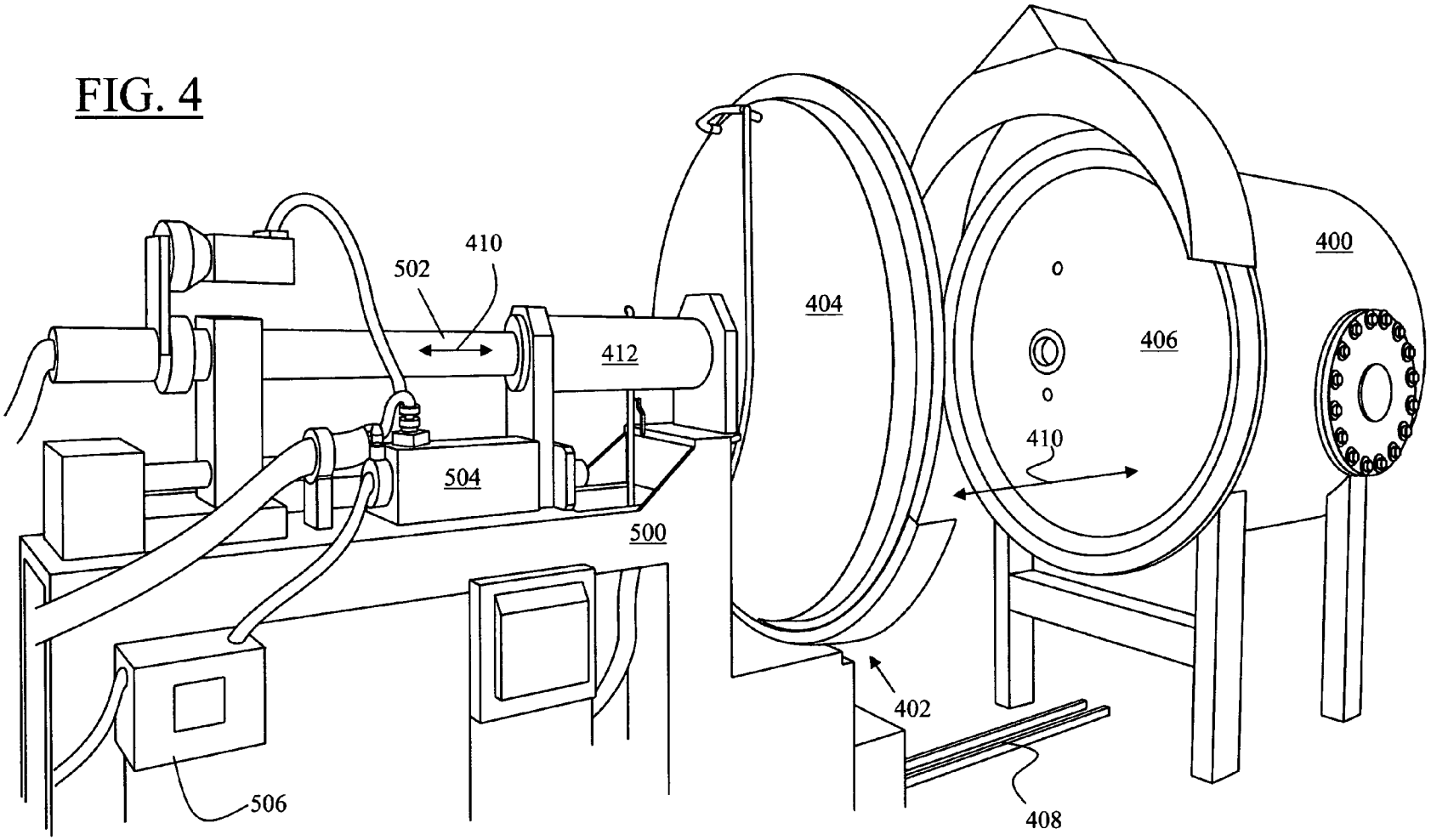
FIG. 4 is an exemplary perspective illustration of a plasma chamber used for the production of the rotary anode in accordance with the present invention.
Figure 5:
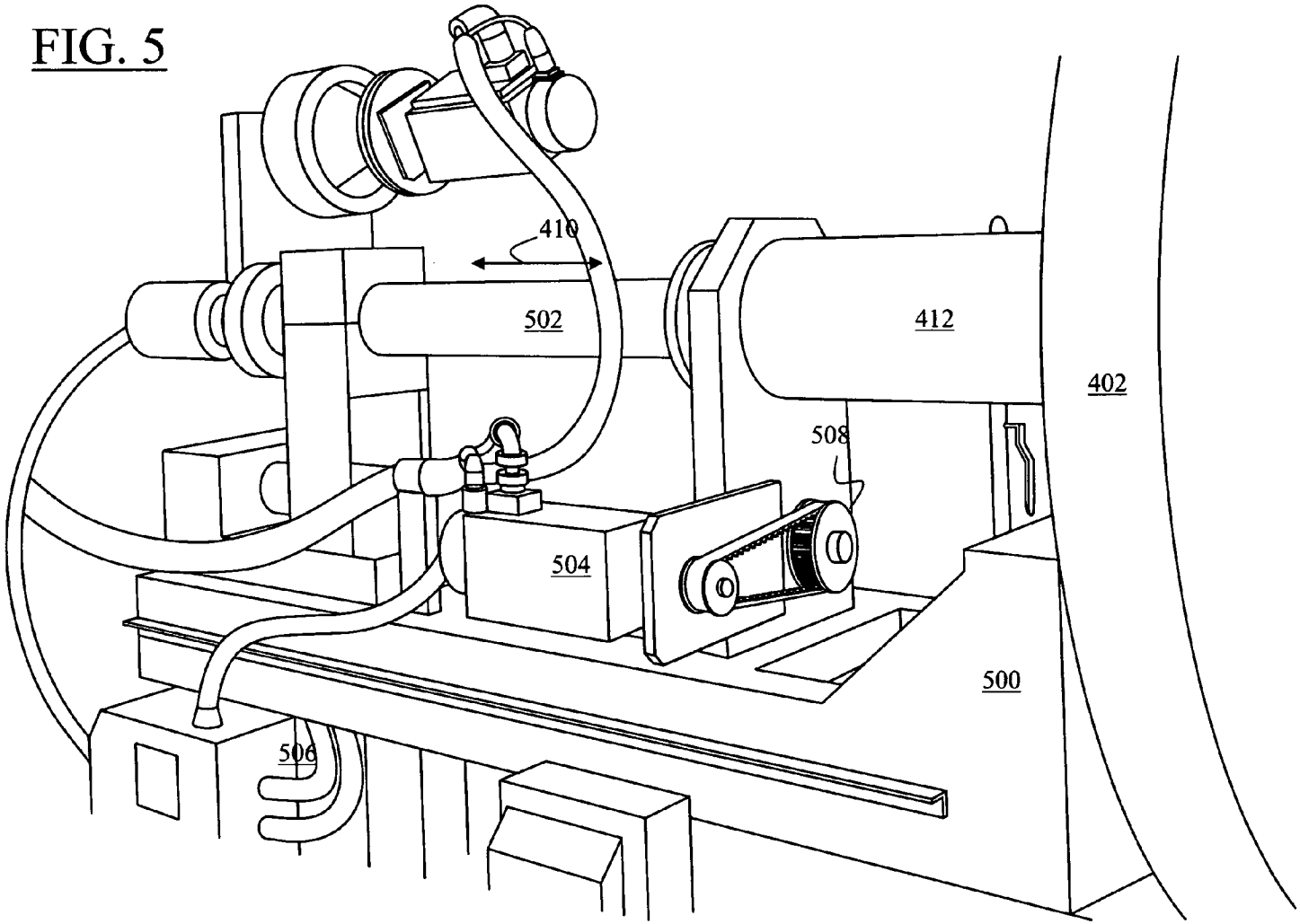
FIG. 5 is an exemplary perspective illustration of the exterior-side of the plasma chamber door, including an axial drive mechanism that facilitates the axial movement of the plasma chamber door.

As illustrated in FIG. 3, at functional act 302, the base 100 is securely placed within a plasma chamber 400 that is illustrated in FIG. 4. FIG. 4 is an exemplary perspective illustration of a plasma chamber 400 used for the production of the rotary anode 202 in accordance with the present invention. As illustrated in FIG. 4, the plasma chamber 400 includes a plasma chamber door 402 that seals the interior 406 of the plasma chamber 400 when closed. The plasma chamber door 402 is moved to a closed position on rails 408 along the longitudinal axis 410 of the plasma chamber 400 by the aid of a axial drive mechanism 500 (illustrated in FIG. 5) in the form of a piston shaft 412 coupled to the exterior 404 of the plasma chamber door 402. FIG. 5 is an exemplary perspective illustration of the exterior-side of the plasma chamber door 402, including the axial drive mechanism 500 that facilitates the axial movement of the plasma chamber door 402. As illustrated, the axial drive mechanism 500 is comprised of a piston 502 that is driven within the shaft 412 to move the plasma chamber door 402 along the longitudinal axis 410 of the plasma chamber 400 by a motor 504 with a drive chain 508 using electric power 506.

Figure 6:
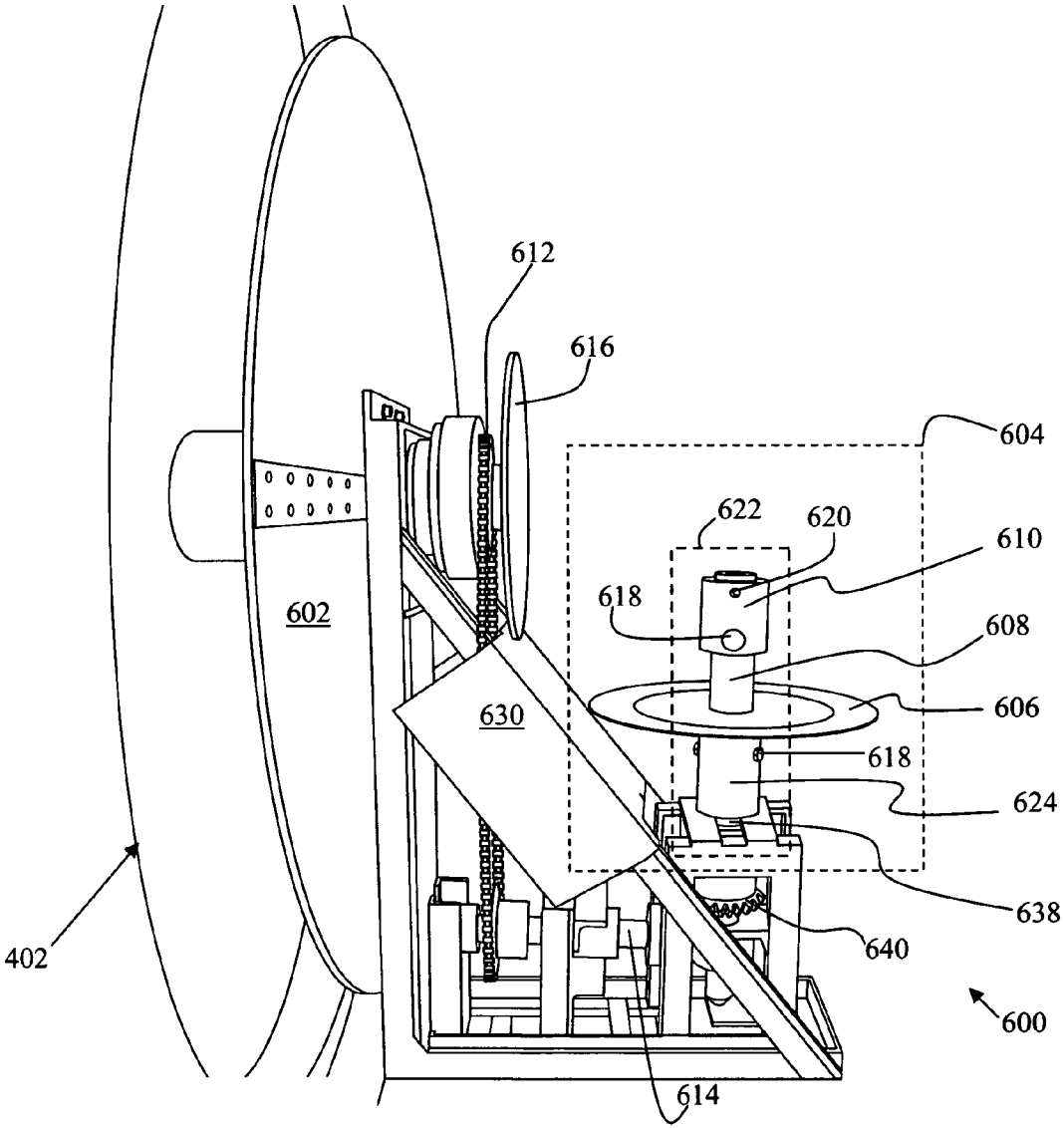
FIG. 6 is an exemplary side-view perspective illustration of an interior-side of the plasma chamber door facing the interior of the plasma chamber 400, including a radial drive mechanism that facilitates the movement of the base along its radial axis of rotation.

FIG. 6 is an exemplary side-view perspective illustration of an interior-side 600 of the plasma chamber door 402 facing the interior 406 of the plasma chamber 400, including a radial drive mechanism that facilitates the movement of the base 100 along its radial axis of rotation 106. As illustrated in FIG. 6, the interior side 600 of the plasma chamber door 402 is comprised of a first shield 602 that protects the plasma chamber door 402 against the interior atmosphere of the plasma chamber (e.g., high temperatures) during operation. Further included in the interior side 600 of the plasma chamber door 402 is a second shield 616 that protects a first part of the radial drive mechanism against the interior atmosphere of the plasma chamber, and a third shield 620 that protects a second part of the radial drive mechanism. Further included is a fourth shield 606, as part of the turntable 604, which protects a third part of the radial drive mechanism. In this exemplary instance, the axial drive mechanism is comprised of a drive chain 612 that rotates a shaft 614, which in turn, rotates an angled sprocket 640 to rotate a shaft 638 coupled with the turntable 604 to rotate the base 100. As further illustrated, the turntable 604 is comprised of a self-aligning fixture 622 that aligns the base 100 with an axial centerline of a turntable 604, with the turntable 604 effecting an axial rotation and translational movement of the base 100 via computer control within the chamber 400. The self-aligning fixture 622 is comprised of high temperature molybdenum alloys, having three longitudinally hollow, independent cylindrical components 610, 608, and 624 locked and centered by the use of eccentric pins 618 that lock in the base 100 thereon, and align the base 100 with the central axis of the turntable 604.

Figure 7:
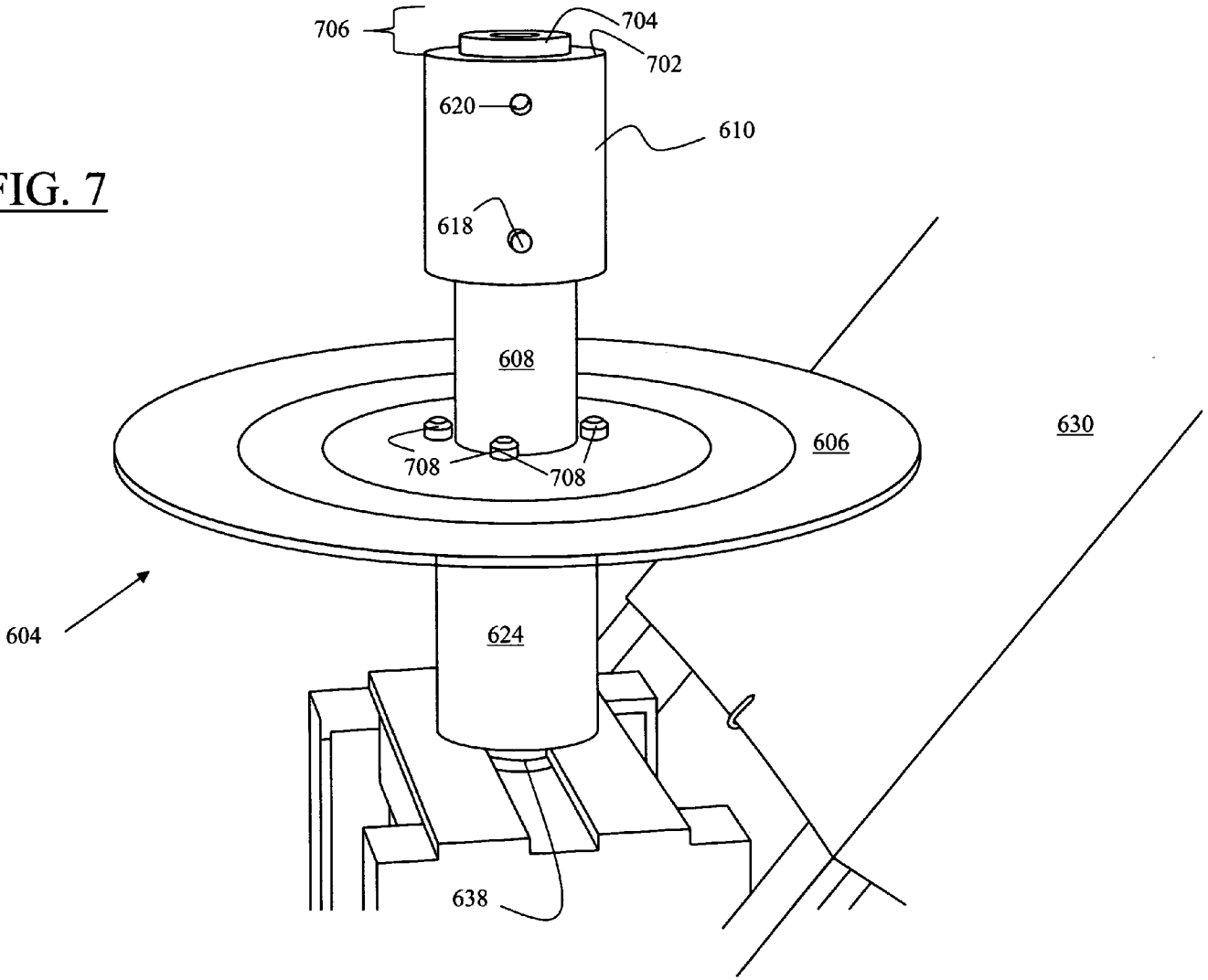
FIG. 7 is an exemplary detailed illustration of a self-aligning fixture illustrated in FIG. 6 in accordance with the present invention.
Figure 8:
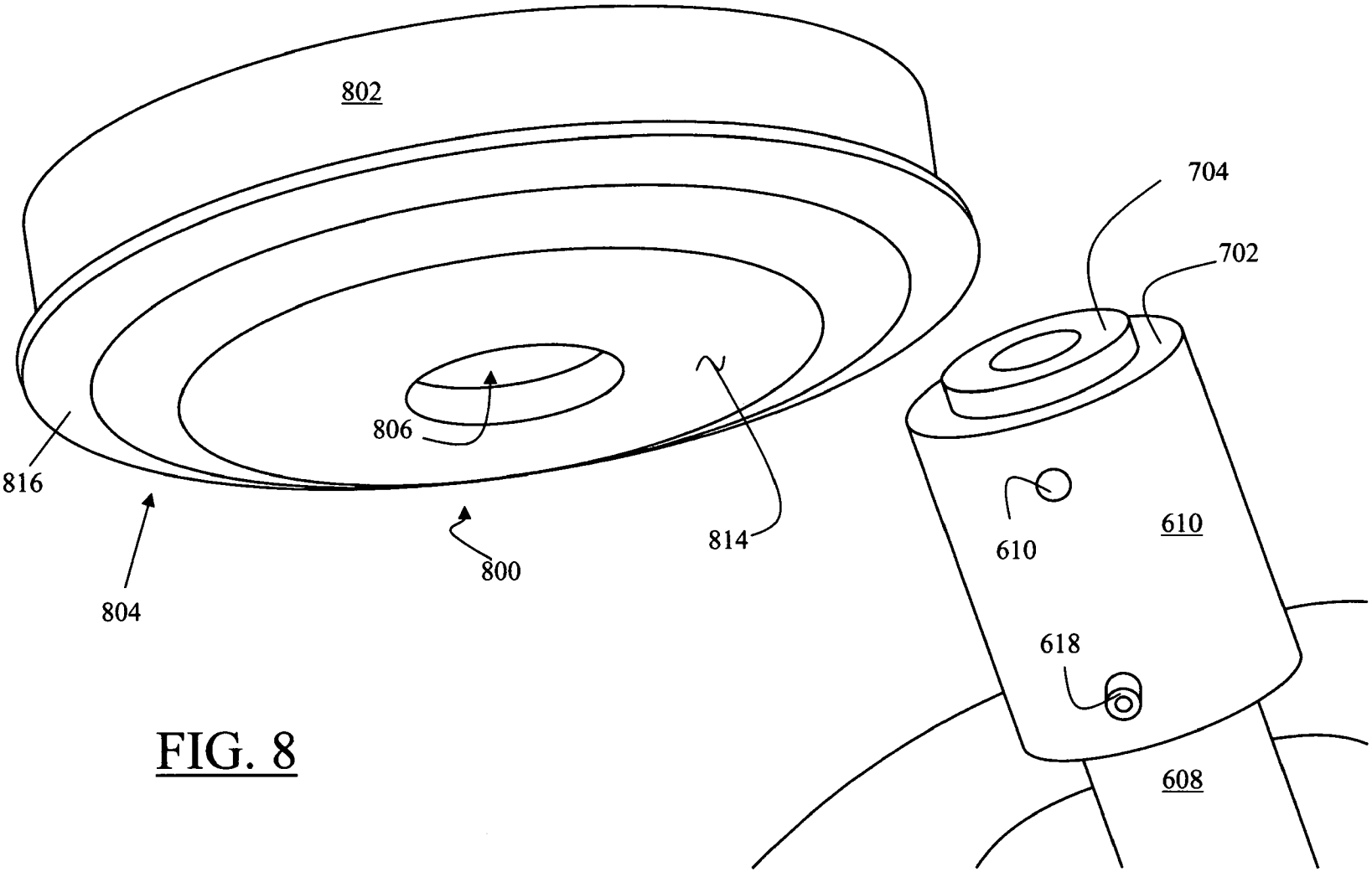
FIG. 8 is an exemplary perspective illustration of an insulator layer in accordance with the present invention.

As best illustrated in FIG. 7, the first cylindrical component 610 includes a top portion 706 that is comprised of a flat horizontal radial section 702 and a vertical radial wall 704, which protrudes and is normal or perpendicular to horizontal radial section 702. As best illustrated in FIG. 8, the top portion of the cylindrical component 610 is configured to accommodate an aperture 806 of an insulating layer 800. The insulating layer 800 is used to provide protection against heat conduction from the base 100 to the self-aligning fixture 622. The insulating layer 800 is comprised of a top section 802 that is comprised of Zirconia or Alumina ceramic disc having an approximate thickness of about 22.5 mm, with a diameter of approximately 220 mm, which can vary commensurate with the size of the base 100 used to produce the resulting anode 200. In other words, the insulating layer 800 with the top section 802 and the bottom 804 prevents heat conduction from the base into the turntable 604. In general, the bottom section 704 of the insulating layer 800 is disc like and is comprised of a molybdenum alloys, and is detachably locked, and rests on the top portion 706 of the first cylindrical component 610. The bottom section 804 is comprised of a circular disc of varying thickness or density with substantially thinner rounded rims or edges at its distal ends, and a circular central aperture 806 at its center. The bottom section 804 includes the central aperture 806 along its axis of rotation, which is longitudinal transverse the diameter length of the entire insulator 800. The insulator 800 is secured on the top portion 706 of the first cylindrical component 610 through the central aperture 806, and rotates about the axial rotation during operation of the plasma. The face or radial plane of the bottom section 804 is generally flat at a proximal end 814 from its radial center axis, and radially beveled or slanted at a distal end 816 thereof. Stated otherwise, the bottom section 804 along its radial longitudinal distal ends 816 is beveled or sloped radially upwards towards the substantially thinner rims or edges. The face or the radial plane, its oblique radial distal end surface 816, and the rims or edges are uniform, contiguous, and integral part of bottom section 804, forming a single unitary piece.

Referring back to FIG. 7, the first cylindrical component 610 is further comprised of two apertures 620, which are transverse to the longitudinal cavity of the first cylindrical component 610. The apertures 620 allow for an insertion of a set of eccentric pins 618 therein to lock in the first cylindrical component 610 to the second cylindrical component 608, and further to lock the insulating layer 800 and the base 100 thereon the top portion 706 of the first cylindrical component 610. As further illustrated in FIG. 7, the self-aligning fixture 622 is further comprised of the second cylindrical component 608, which is detachably locked in with the first cylindrical component 610 via the set of eccentric pins 618 at one end, the fourth shield 606 at the other via a set of fastener. Non-limiting example of fasteners used may include the illustrated set of nuts and bolts 708. The third cylindrical component 624 is detachably locked in with the bottom side of the fourth shield 606 via a set of fastener, and rests on a rotating cylinder 638, with the rotating cylinder 638 effecting the axial rotation of the turntable 604.

Figure 9:
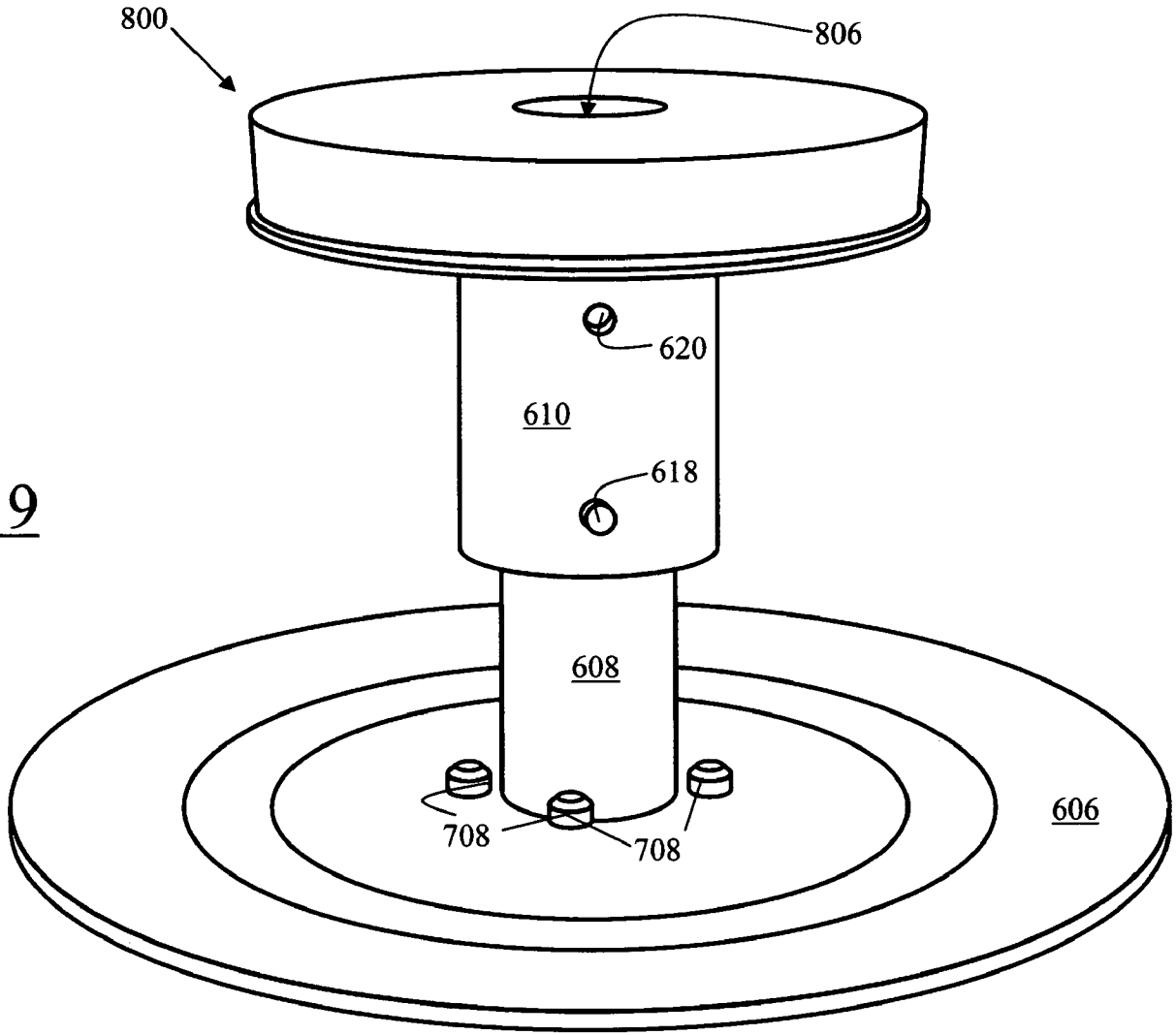
FIG. 9 is an exemplary perspective illustration of the insulating layer illustrated in FIG. 8, which is detachably mounted onto the self-aligning fixture in accordance with the present invention.
Figure 10:
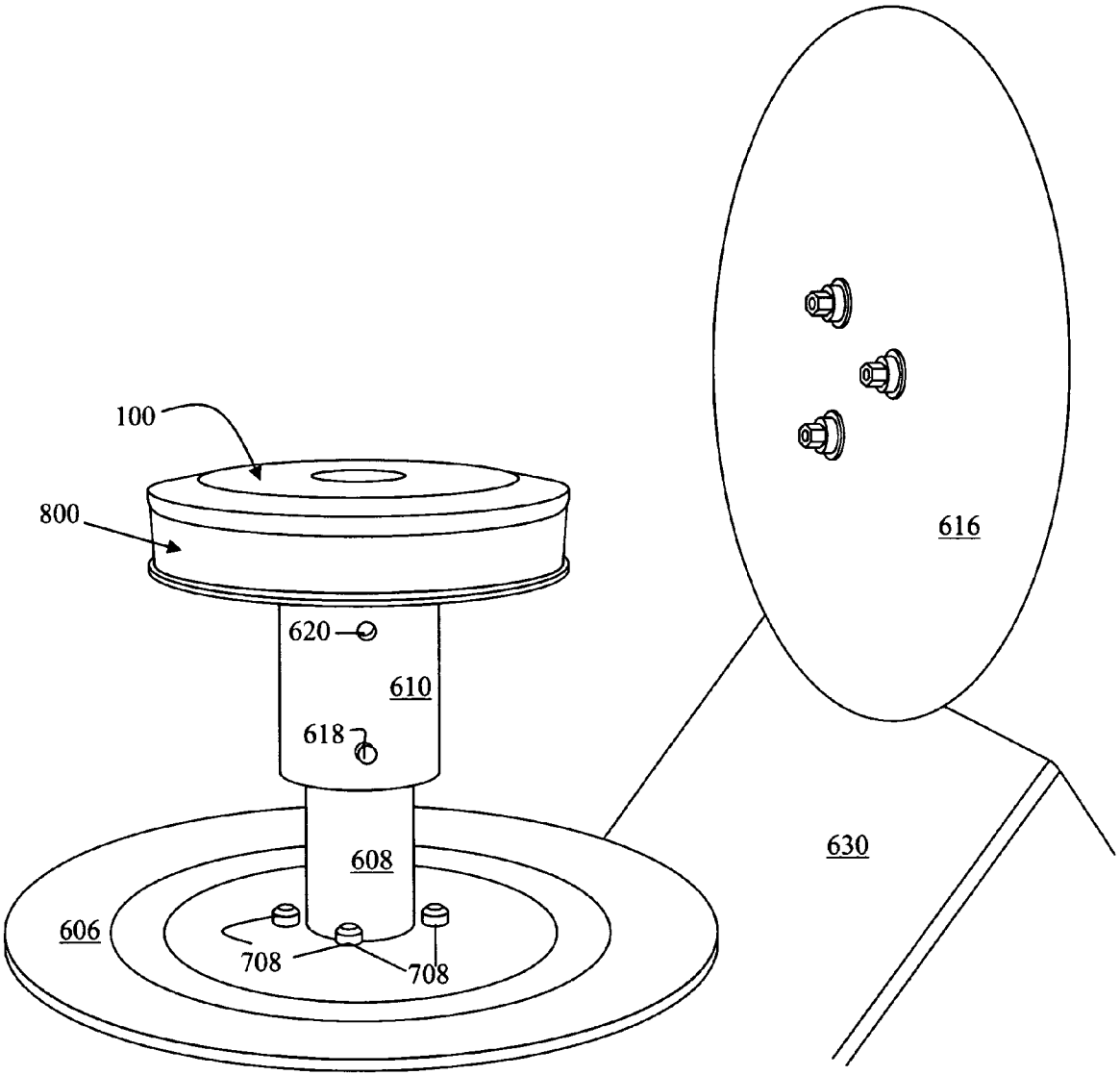
FIG. 10 is an exemplary perspective illustration of the base detachably mounted onto the insulating layer and the self-aligning fixture in accordance with the present invention.
Figure 11:
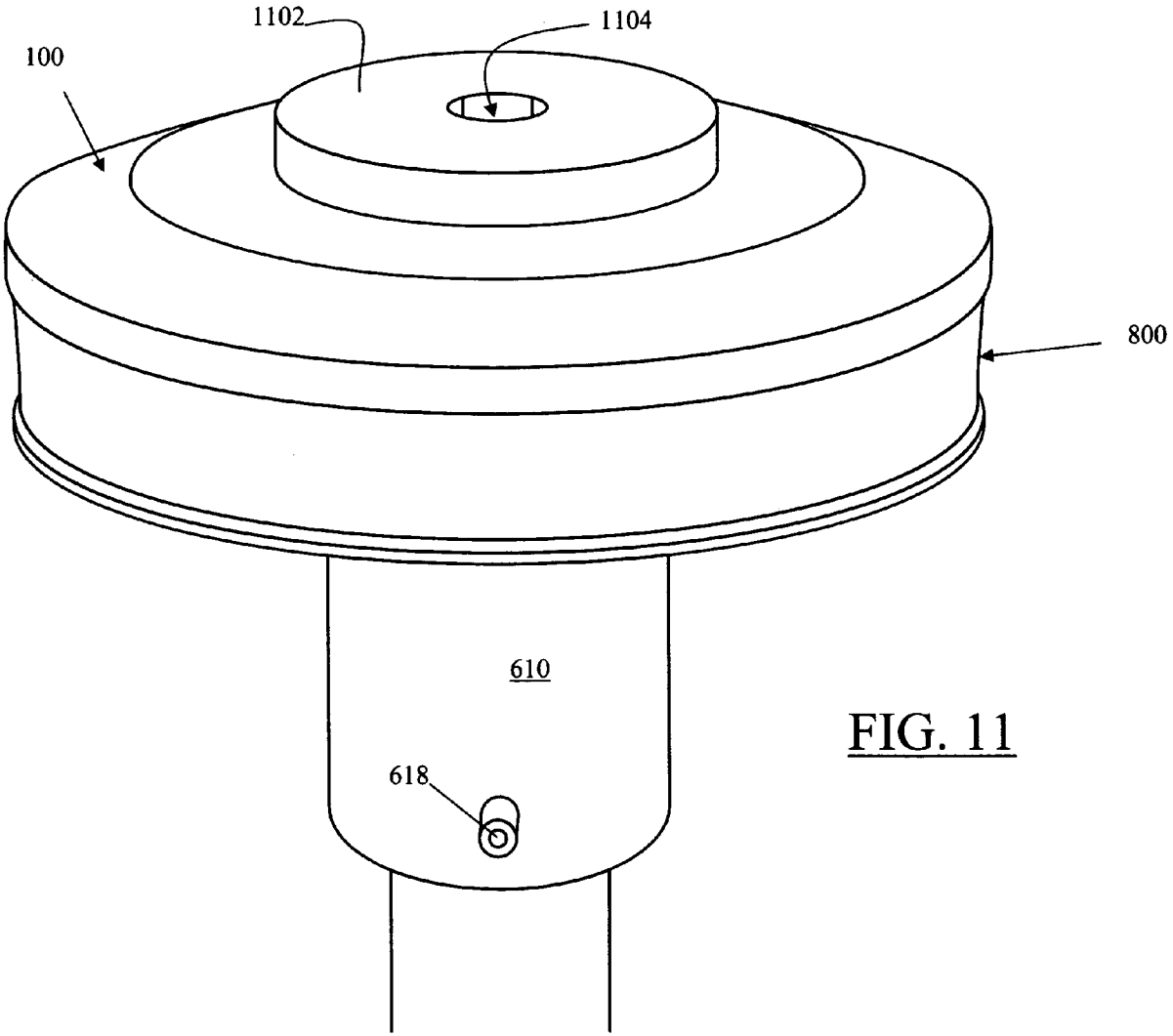
FIG. 11 is an exemplary perspective illustration of a mask detachably mounted onto the base illustrated in FIG. 10 in accordance with the present invention.
Figure 12:
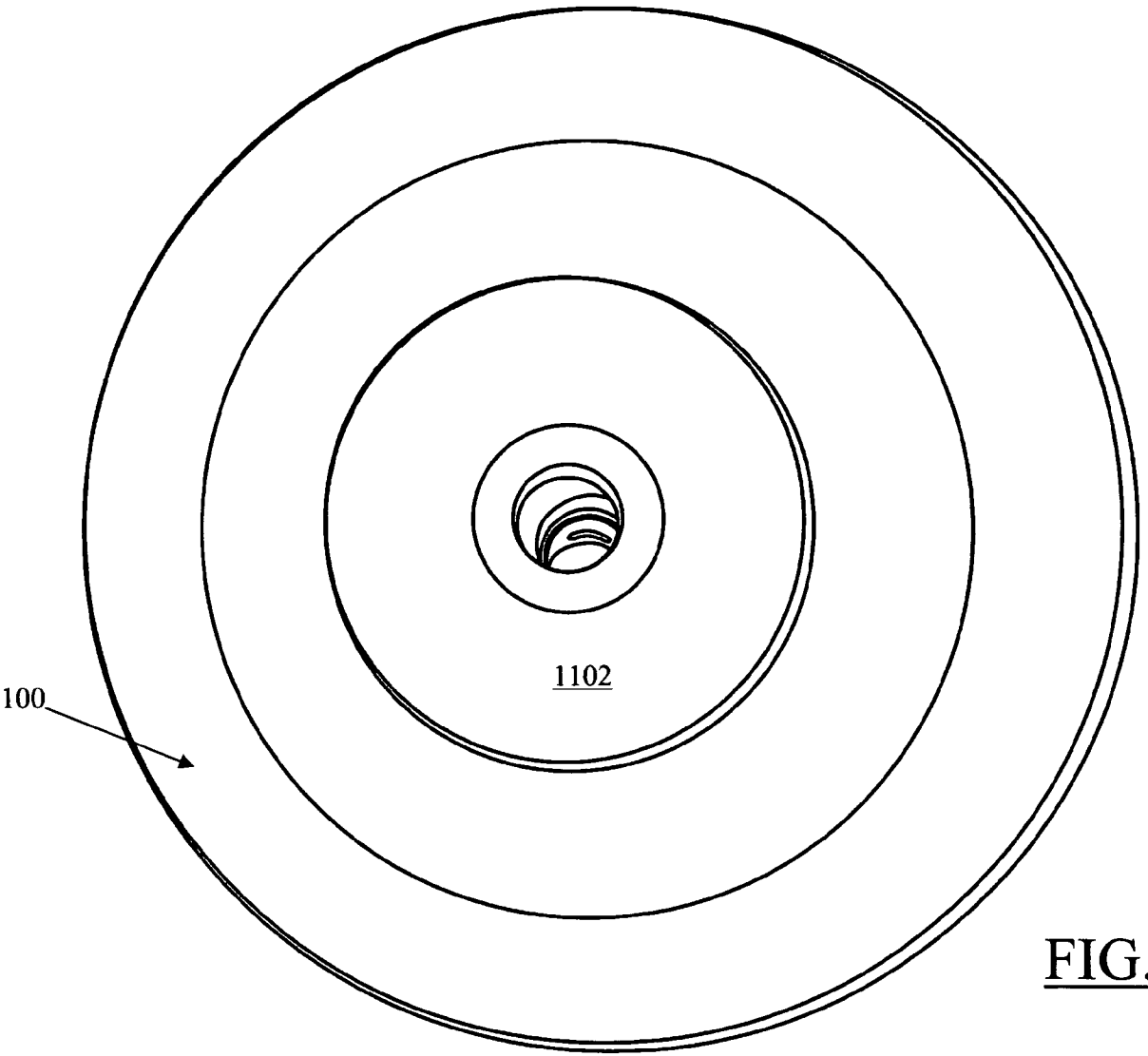
FIG. 12 is an exemplary top view illustration of a mask illustrated in FIG. 11 in accordance with the present invention.

FIG. 9 is an exemplary side-perspective illustration of an insulating layer 800 placed on top of the first cylindrical component 610, and FIG. 10 is an exemplary side-perspective illustration of a base 100 placed on top of the insulating layer 800. As described above, during the coating cycle of the base 100 to produce the focal track layer 202, the insulating layer 800 provides protection against heat conduction from the base 100 to the self-aligning fixture 622. FIG. 11 is an exemplary side-perspective illustration of a mask 1102 placed on top of the base 100, and FIG. 12 is an exemplary top-perspective illustration of the mask illustrated in FIG. 11. As illustrated in both FIGS. 11 and 12, the mask 1102 is placed on top of the base 100 to shield areas of the base 100 adjacent the focal track layer 202 from tungsten and tungsten alloy spray deposits. Non-limiting example from which the mask 1102 may comprise of may include Molybdenum alloys, alumina or Zirconia ceramics. The ceramics may be used so long as a conductive path is established for performance of reverse ach cleaning. The mask 1102 is exemplary illustrated as a disc, with a central aperture 1104. The dimensions of the mask 1102 may vary commensurate with the dimensions of the base 100 being coated.

Figure 13:
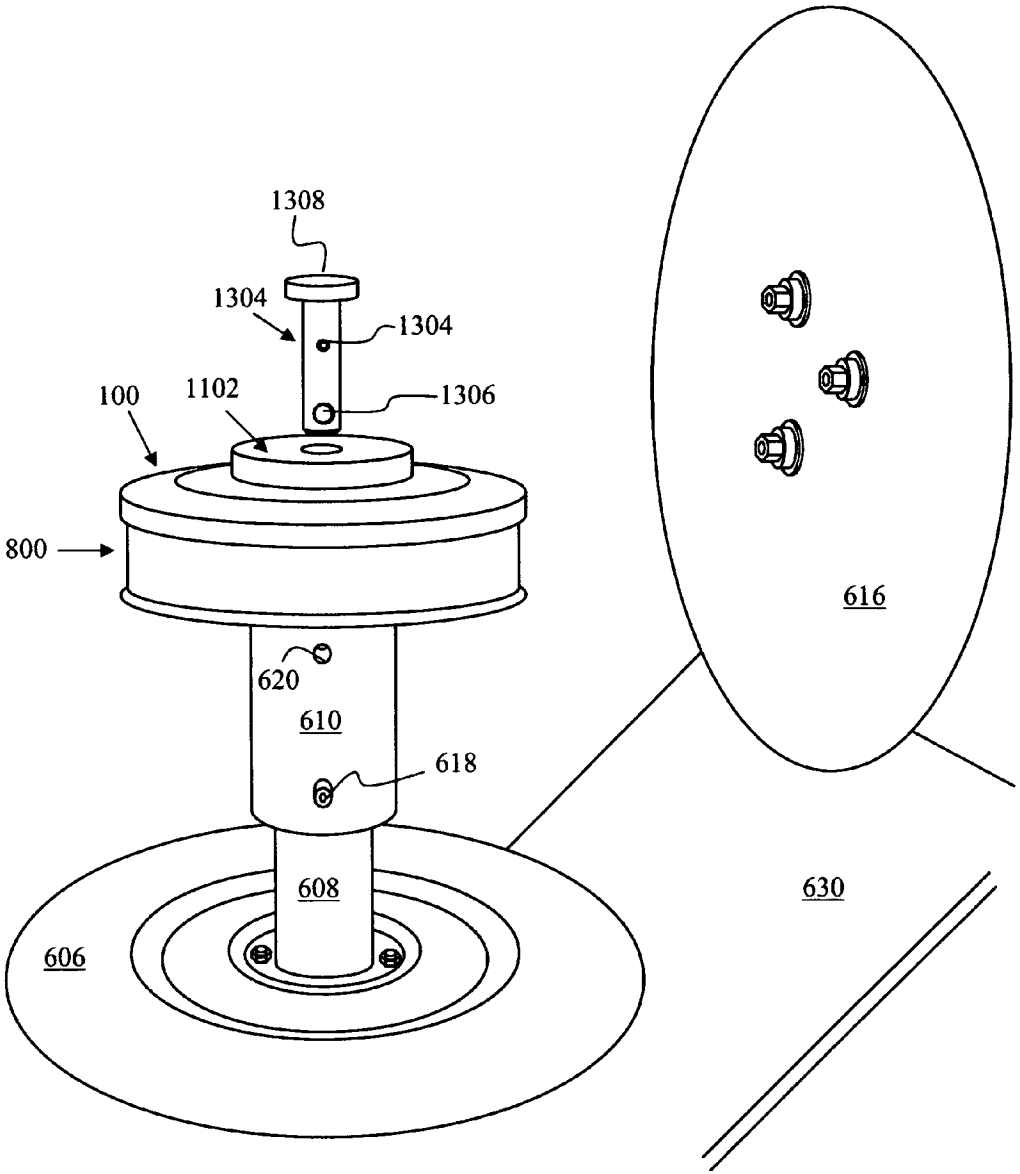
FIG. 13 is an exemplary perspective illustration of a locking mechanism used for detachably locking and securing the mask, base, and the insulating layer onto the self-aligning fixture in accordance with the present invention.

As best illustrated in FIG. 13, the mask 1102 is coupled with the self-aligning fixture 622 by an exemplary illustrated first locking mechanism 1302 for quickly and easily locking and releasing the mask 1102, base 100, and insulating layer 800 together with the self-aligning fixture 622, thereby preventing all components thereon the self-aligning fixture 622 from wobbling during coating cycle when the entire turntable 604 rotates. As illustrated in FIG. 13, the first locking mechanism 1302 is comprised of a body 1304 that has a grip section 1308 at a first end of the body 1304 with dimensions larger than the diameter of at least the aperture 1104 of the mask 1102. Further included on the body 1304 of the first locking mechanism 1302 is an aperture 1306 that is transverse in relation to the longitudinal axis of the body 1304, located at a second end thereof. In this instance, the exemplary illustrated first locking mechanism 1302 is inserted through the holes 1104, 104, and 806 of the respective mask 1102, base 100, and insulator 800, and the respective first and second cylindrical components 610 and 608, with the aperture 1306 of the first locking mechanism 1302 aligned with the aperture 620 of the first cylindrical component 610.

Figure 14:
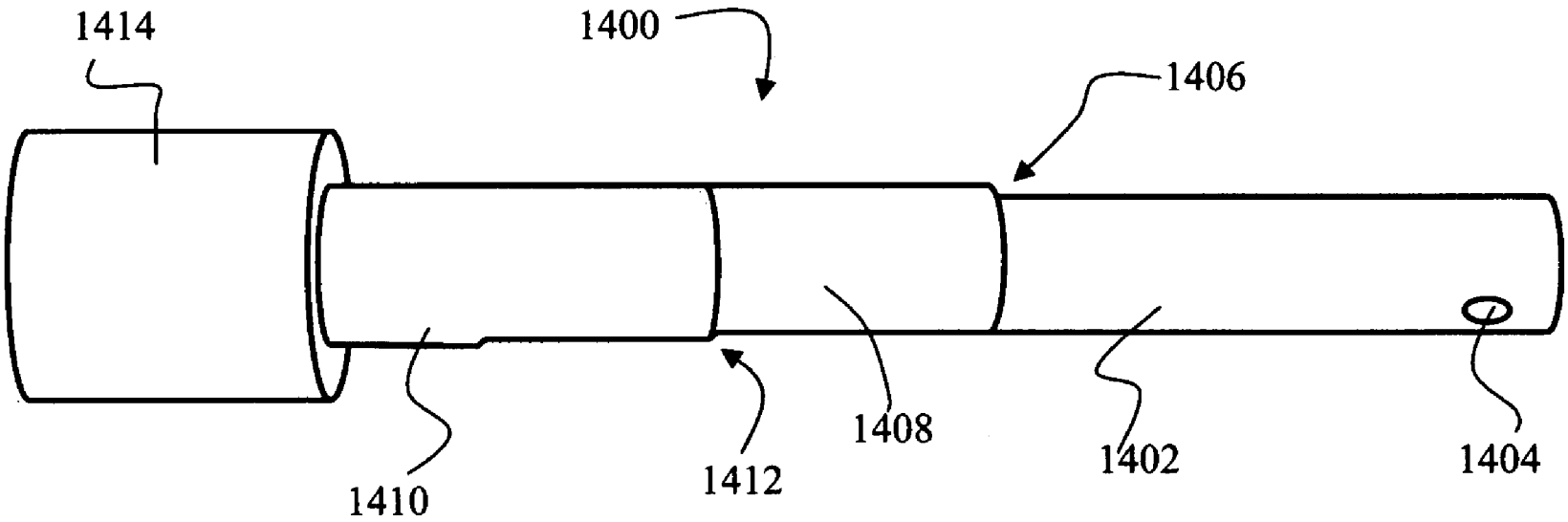
FIG. 14 is an exemplary perspective illustration of an eccentric pin in accordance with the present invention.
Figure 15:
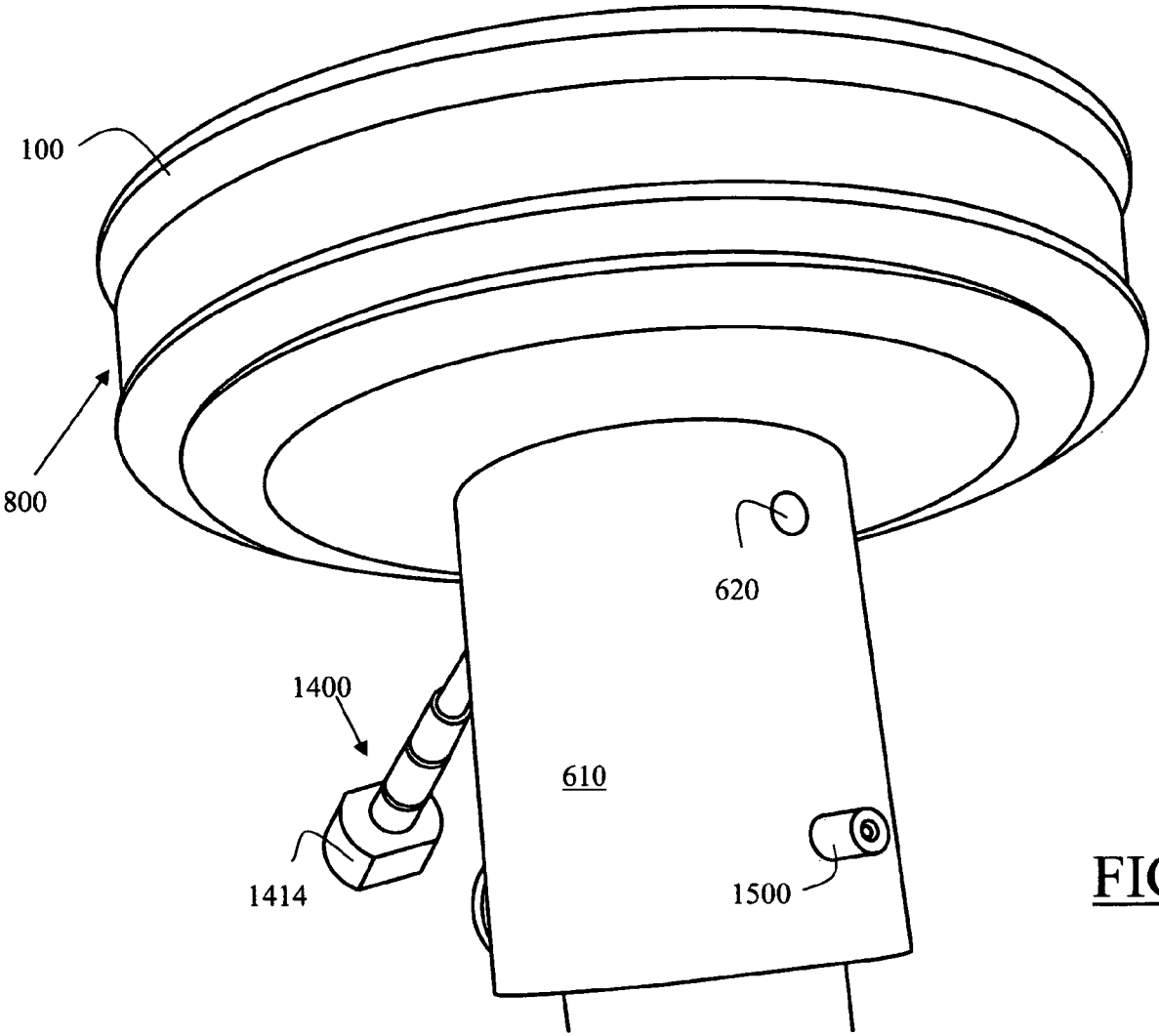
FIG. 15 is an exemplary perspective illustration of the eccentric pin of FIG. 14, used to securing the locking mechanism of FIG. 13 with the self-aligning fixture in accordance with the present invention.

As best illustrated in FIGS. 14 and 15, an eccentric pin 1400 is used to interlock with the first locking mechanism 1302, thereby secure the base 100 onto the turntable 604. However, it should be noted that other means of attachments are also possible, non-limiting example of which may include twist lock, "V" shaped pins, etc. for mass manufacturing of the rotary anode. As illustrated, the eccentric pin 1400 is comprised of a grip 1414, with dimensions larger than the dimensions of the aperture 620 of the first cylindrical component 610. The eccentric pin 1400 further includes a first cylindrical section 1410, a second cylindrical section 1408, and a third and final cylindrical section 1402, all with varying diameters. The central axis of each of the cylindrical sections 1410, 1408, and 1402 is off the center of the longitudinal mean central axis of the pin 1400, creating the vertical edges 1406 and 1412, transverse the longitudinal central axis of the pin 1400.

Figure 16:
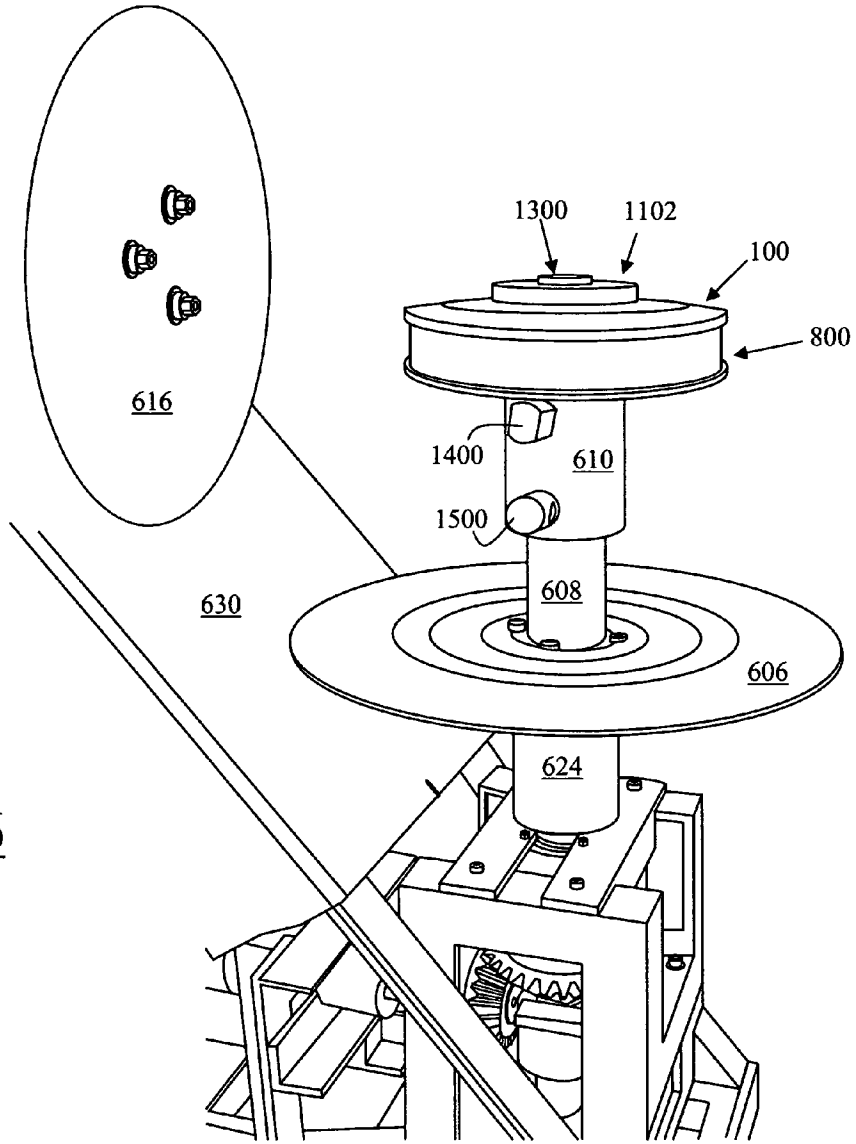
FIG. 16 is an exemplary perspective illustration of a fully assembled base onto the self-aligning fixture in accordance with the present invention.

As was described above the first locking mechanism 1300 is inserted vertically along the hollow longitudinal length of the mask 102, base 100, insulator 800 and the cylindrical components 610 and 608 of the turntable 604. As illustrated in FIGS. 15 and 16, at least two eccentric pins 1400 and 1500 are inserted horizontally, transverse the longitudinal hollow length of the above mentioned components. FIG. 16 is an exemplary illustration of a fully assembled base 100 ready for coating of the focal track layer 202 thereon, with all the interlocking pins 1300, 1400, and 1500 detachably interlocking and securing all components to the turntable 604.

Figure 17:
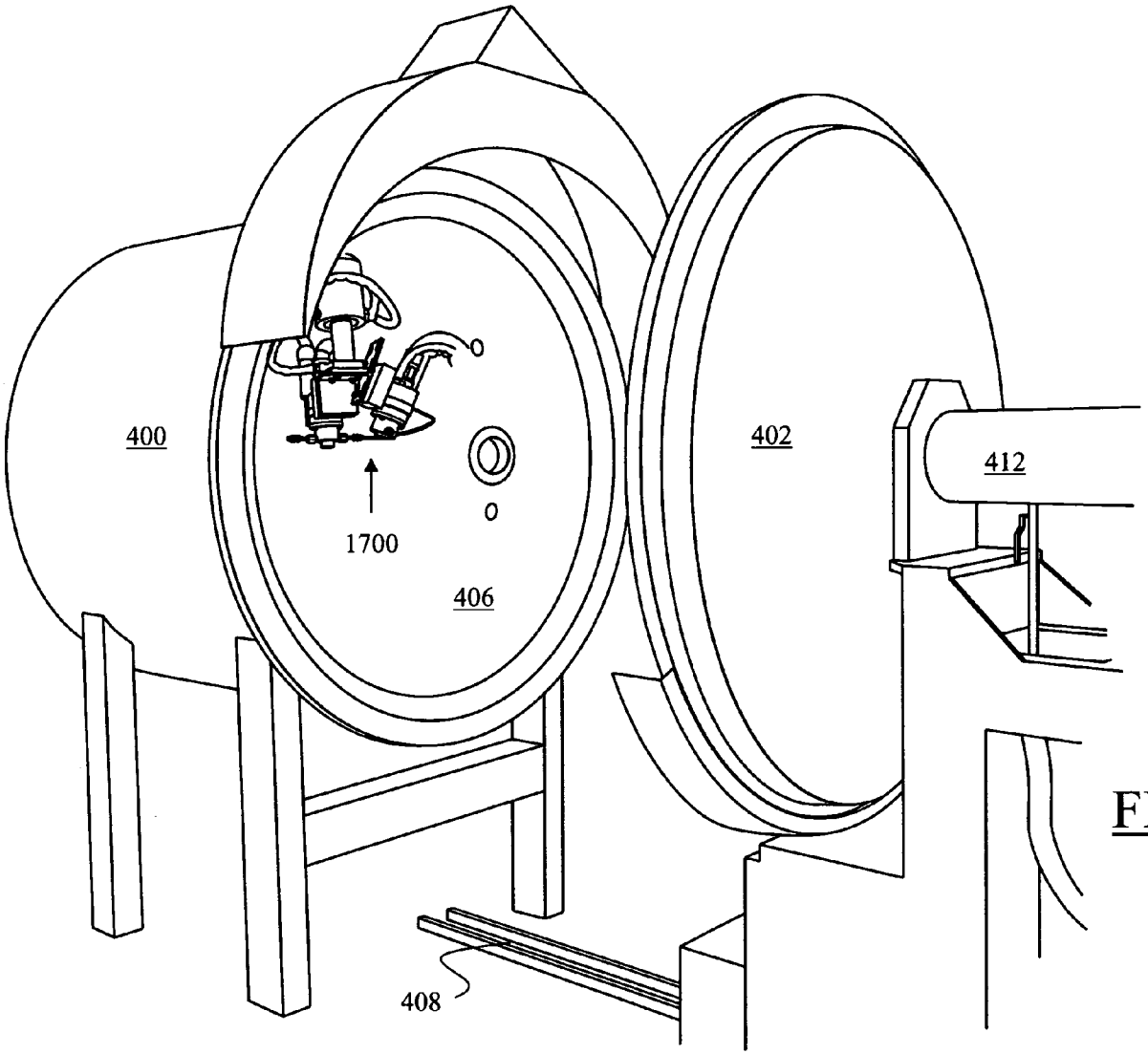
FIG. 17 is an exemplary perspective illustration of a pair of plasma guns inside the plasma chamber in accordance with the present invention.
Figure 18:
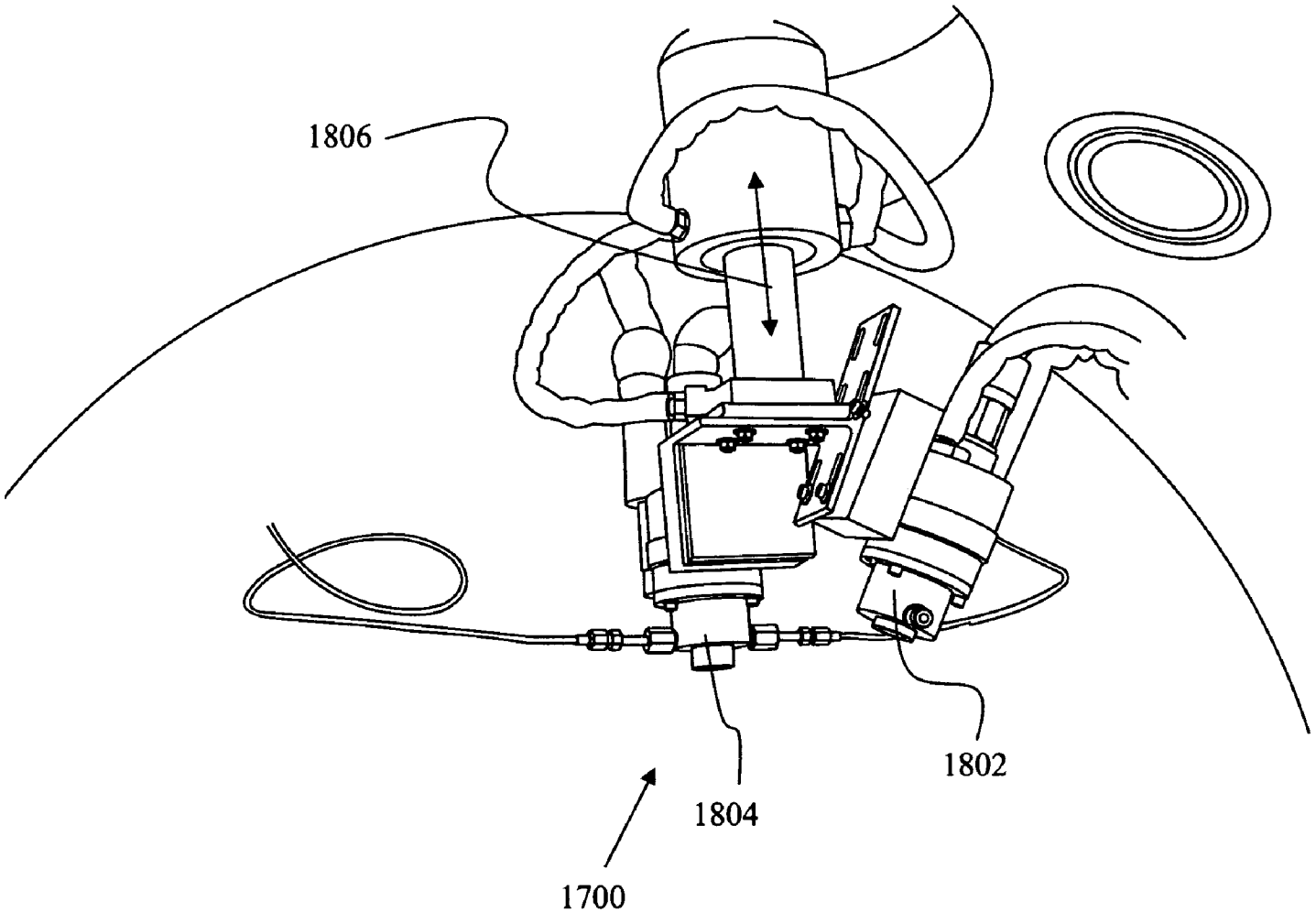
FIG. 18 is an exemplary detailed perspective illustration of the pair of plasma guns inside the plasma chamber illustrated in FIG. 17 in accordance with the present invention.

FIG. 17 is an exemplary perspective illustration of perspective of the plasma chamber 400 used for the production of the rotary anode 202, illustrating a plasma gun and one of an auxiliary heat source and a plasma gun 1700 in accordance with the present invention. FIG. 18 is an exemplary perspective illustration of the inside of the plasma chamber 400, illustrating the details of the plasma gun and one of an auxiliary heat source and a plasma gun 1700 in accordance with the present invention. As best illustrated in FIG. 18, the present invention uses a low pressure plasma to spay material as a focal track layer 202 on to the base 100, including use of at least one plasma gun 1802 and one or more auxiliary heating sources 1804, which in this exemplary instance is a second plasma gun. The plasma guns 1802 and 1804 move inside the chamber 400 in a vertical orientation 1806 in relation to the base 100.

Referring back to FIG. 3, after secure placement of the base 100 within the plasma chamber 400, the functional act 302 further requires that the plasma chamber 400 be evacuated, which is the first lowering of the chamber pressure for removal of gases. In general, the first lowering of the chamber pressure is reduced to approximately 400 micrometers and lower to reduce residual reactive gasses within the plasma chamber 400 to negligible levels. As indicated in the functional act 304, inert gas is then introduced into the plasma chamber 400 at a low pressure for forming a protective environment. Non-limiting example of an inert gas introduced into the plasma chamber 400 may include argon, and is set to increase the chamber 400 pressure to an approximate pressure of about 5 to 60 torr (20-26 Pa, which is 150-200 millitorr).

At functional act 306, the plasma guns 1802 and 1804 are ignited, and well-known software applications within a computer generate computer controls for control of pressure of the chamber, motion of the plasma guns 1802 and 1804, and a rotary and translational axis of the base 100. That is, the computer is coupled with pumps and other mechanisms to effect a computer control of the mechanical motions of movable components, and chamber pressures. The computer program increments the base 100 towards the plasma flames and allows traversing of the guns and target across the focal track 202.

Figure 19:
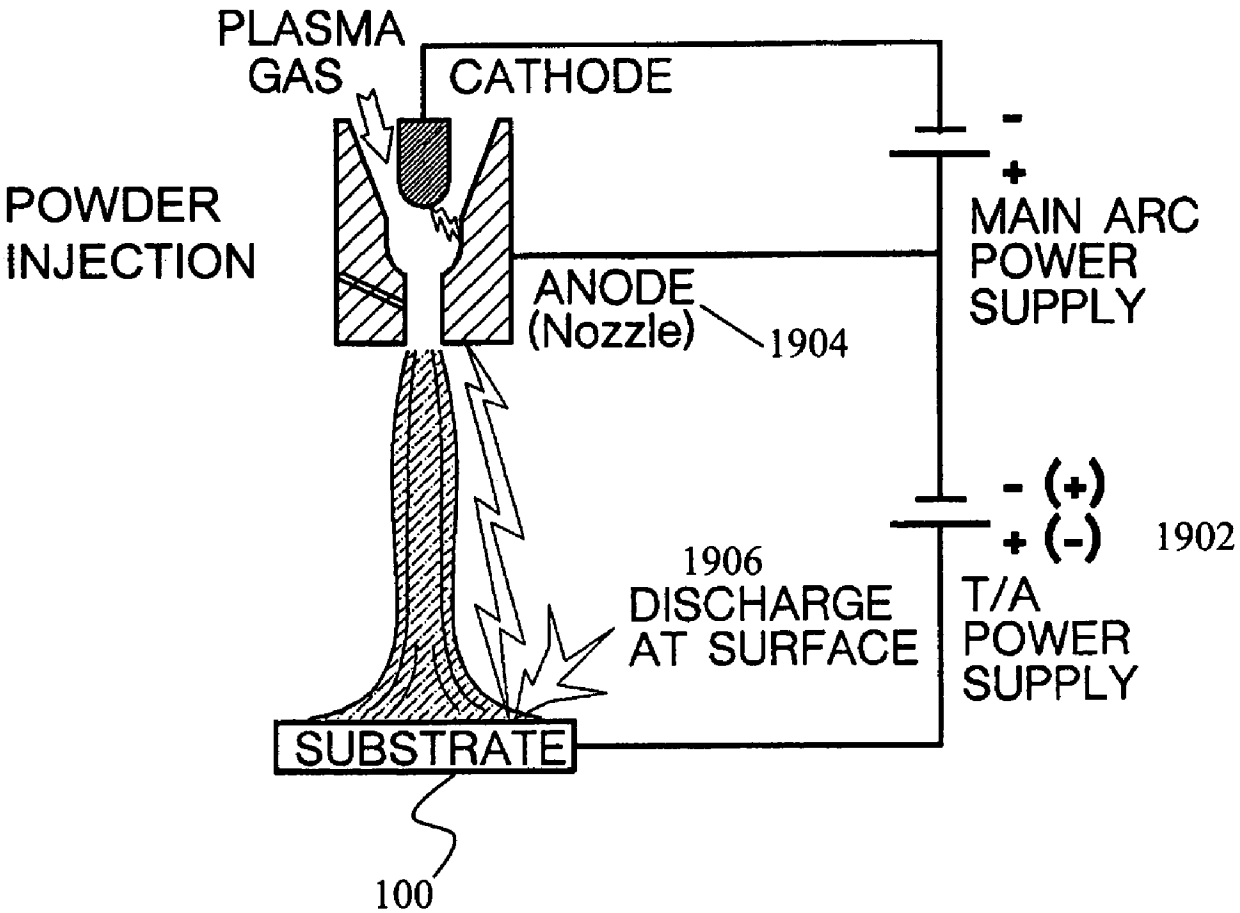
FIG. 19 is an exemplary schematic illustration of a cleaning process of the base inside the plasma chamber in accordance with the present invention.

As indicated at functional act 308, prior to the commencement of the coating cycle, the base 100 is cleaned for removal of oxides and dirt. As illustrated in FIG. 19, the cleaning of the base 100 includes using negative reverse transferred arc using the plasma guns 1802 and 1804. The negative reverse transferred arc includes providing a supplemental power supply 1902 coupled with at least one of the plasma guns 1802 and 1804 to form a bias from an anode 1904 of the selected plasma gun to the base 100, which when ignited, creates arcing and removes and pulls off surface oxides and dirt 1906 from a surface of the base 100. In general, the duration of cleaning lasts approximately from about 60 to 90 seconds, with a power input of approximately 20 Kw. It has been determined that effective cleaning of the base 100 is accomplished when the distance between the nozzles of the plasma guns 1802 and 1804 and that of the base 100 is greater than 10 inches. Hence, for cleaning the base 100, the plasma guns 1802 and 1804 are moved in a vertical orientation in the direction indicated by the arrow 1706 (up or down) to adjust for optimum distance for cleaning the base 100. When using two plasma guns 1802 and 1804, one plasma gun can be used for substrate cleaning and heating while the other for deposition. Therefore, the functional acts of 308 and 310 may be performed simultaneously.

As further indicated in the exemplary flow chart of FIG. 3, prior to actual commencement of the coating cycle, at the functional act 310, the coating material for the focal track layer 202, which is already de-agglomerated, is further de-agglomerated and the base 100 pre-heated. In general, the focal track layer 202 is constructed from material that is comprised of tungsten and tungsten alloys, non-limiting examples of tungsten alloys may include tungsten rhenium alloys that are comprised of rhenium from 3.5 wt % up to a solubility limit in the tungsten, preferably, with the rhenium content between 5 to 10 wt %. The powders may be manufactured by mixing elemental tungsten and rhenium powders in the appropriate compositions, sintering, and milling into the required size range, or reducing tungstic acid or the trioxide with ammonium perrhenate in hydrogen to form the alloy powder. Higher densities in the as sprayed condition is obtained when using powder manufactured by obtaining pure tungsten powder of the appropriate size, which is also coated with ammonium perrhenate and reducing the coating to form rhenium metal on the surface of the tungsten powder, in accordance with the present invention.

An emissive layer of special ceramic or brazed graphite is generally applied to the bottom surface of the base 100 for heat management. As indicated above, X-rays are created by bombarding the focal track layer 202 with electrons, and as a result of the high energy densities delivered to the focal track layer 202, exceptionally high temperatures are generated on the focal track layer 202 of approximately 2100° C. with the base 100 experiencing temperature of 1300° C. or higher. These aggressive thermal conditions including the fact that the anode 200 is in high vacuum, require the base 100 and focal track layer 202 to be extremely dense, gas free, and well bonded to each other. The high density aids in low gas emission and in low roughening rates due to crack formation from thermal stresses. The preferred microstructure of the tungsten and tungsten alloy used as the focal track layer 202 is an equiaxed grain structure with a uniform grain size. Too fine a grain size will initiate multiple cracks due to the presence of more grain boundaries, and too large a grain size will lead to deeper cracks. It is preferred that the final microstructures of the focal track layer 202 have minimal pores located in grain boundary areas since crack initiation always occurs at grain boundaries. It should be noted that equiax grains have even distribution of stresses along all sides because equiax particles have equal sides, whereas the columnar grains have the possibility of longer cracks along columnar grain boundary. Accordingly, equiaxed grain structure is preferred.

An important aspect recognized by the present invention is the use of a narrow tungsten and tungsten alloys particle size distribution so that particles experience approximately the same thermal, velocity, and trajectory histories. Therefore, according to the present invention, tungsten and the tungsten alloy used as the focal track layer 202 are preferably comprised of a de-agglomerated tungsten or tungsten alloy powder, with a powder particle size ranging from approximately 2 micrometers to about 15 micrometers, with a $D_{50}$ of 8 to 10 micrometers. This allows for uniform melting of the particles and velocities that exceed 200 m/sec. The impurities of other metallic constituents or elements are less then 50 ppm and the powder used is generally free flowing. This results in extremely good packing density and good homogeneity of structure. The narrow grain size also allows for a uniform equiaxed grain size during processing as described in this invention. It is also preferable for the initial powder feedstock to have a low degree of agglomeration, since agglomeration can cause sintering into larger particles during flight in the plasma and lead to heterogeneous grain size and pore distribution during processing. Accordingly, as illustrated in the functional act 310, the already de-agglomerated tungsten alloy powder is further de-agglomerated.

The further de-agglomeration process may include heating the de-agglomerated tungsten alloy powder to an approximate temperature of about 38° C. in a canister to evaporate and remove most of the existing moisture therein the powder, and with the addition of silica pads therein to further absorb any remaining moisture. The process of heating the de-agglomerated tungsten alloy powder is continued until it is deemed flow-able. Flow-ability of the de-agglomerated tungsten alloy powder is determined by testing it through a powder feeder connected to one of the plasma gun 1802 or 1804, and determining if the flow rate of the de-agglomerated tungsten alloy powder meets certain pre-set conditions.

A second method of further de-agglomeration of the already de-agglomerated tungsten alloy powder is to use the powder feeder itself, which includes a vibrator. The continuous vibration action during the coating process eliminates settling of the powder particles, and electrostatic charges between the powder particles that may cause agglomeration and hence, eliminating or preventing static agglomeration of the particles. Of course, both the heating and vibration methods may be combined as a single further de-agglomeration process for further de-agglomerating the already de-agglomerated tungsten alloy powder. That is, in this third method, the powder feeder is heated, which removes moisture, and it vibrates which eliminates static charges between particles before the de-agglomerated tungsten alloy powder is introduced into the plasma guns.

As further illustrated in FIG. 3, prior to commencement of the coating cycle, at functional act 310 the base 100 is preheated to a minimum of 1300° C. In general, the duration of preheating the base 100 to a minimum of 1300° C. and higher is approximately 3 to about 4 minutes, which allows for re-crystallization of equiaxed grain of the tungsten alloy particles, when deposited onto the base 100 as the focal track layer 202 using the plasma guns 1802 and 1804. In accordance with the present invention, a porosity gradient is noticed from the target base 100 to the surface of the overlay if the temperature of the base 100 falls below 1300° C. during the deposition process due to heat losses from radiation and conduction. This is particularly noticeable on larger bases. The use of dual guns or auxiliary heaters in accordance with the present invention allows the maintenance of temperature of the base 100, and therefore, elimination of porosity.

As illustrated in FIG. 3, the coating cycle commences at functional act 320, where the base 100 is coated to desired coating thickness with the finally de-agglomerated tungsten alloy powder introduced into one of the plasma guns 1802 or 1804 for depositing thereof onto the base 100. The coating cycle is commenced by low pressure plasma spraying of the base 100 with the de-agglomerated tungsten alloy powder to desired coating thickness using one of the plasma guns 1802 or 1802, and maintaining even heating of the base 100 using one of other plasma gun 1802 or 1804. In general, for coating, it is preferred that the plasma gun used for coating be approximately 6 inches away from the base 100. It should be noted that the duration of the coating cycle is approximately 16 minutes, and is comprised of moving the base 100 under the plasma guns 1802 and 1804 through the rotational and translational motion of the base 100.

As indicated above, during the coating cycle the chamber 400 pressure is maintained between 5 to 60 torr. The size of particles used (ranging form approximately 2 micrometers to about 12 micrometers, with a $D_{50}$ of approximately 8 to 10 micrometers) in combination with a low pressure allows for high acceleration of the particles 220 m/sec with minimized drag forces. Hence, during coating cycle the present invention establishes a Mach 3 condition as a minimum for the plasma. The present invention has determined that sufficient and optimum heating of tungsten and tungsten rhenium particles occur in Mach 3 conditions so as long as the particles are in the size ranges described. That is, narrow particle size distribution of between 2-15 micrometers or less allows the particles to experience approximately the same thermal, velocity, and trajectory histories and to accelerate them to over 220 m/sec using chamber 400 pressures of under 50 torr, creating a homogeneous densely packed focal track layer 202. The maintenance of high substrate temperatures (1300° C. and above) cause recystallization of the spray particles into equiaxed grains, which further increase the density of the focal track layer 202.

As was indicated above, during coating cycle, dual plasma guns 1802 and 1804 or auxiliary heaters are used that allow for evenly distrusted and maintenance of temperature of the base 100. This is particularly beneficial for larger sized anodes in that as the anode diameter increases to 200 mm and above, rapid cooling from radiation and conduction into the self-aligning fixture 622 occur. This results in Lamellar or mixed lamellar/fine equiaxed grain structure as the focal track layer 202, which results limiting the density of the focal track layer 202 to a maximum of 93% of theoretical. Maintaining anode body temperatures above 1300 during deposition (coating cycle) leads to equiaxed structure with densities above 96% of theoretical. As indicated above, preferred methods of maintaining temperature are to use a second plasma torch or other heat sources. These auxiliary heat sources may include but are not limited to resistance or inductive heating elements protected from the plasma and dust environment that are generated within the chamber 400. The present invention provides that for base 100 comprised of TZM, optimum temperatures are approximately 1300-1500° C. so as to avoid recystallization of the base 100. For oxide or carbide dispersed molybdenum alloys, temperature of up to approximately 1700° C. can be used to optimize not only the density of the focal track layer 202 but also to enhance the bond between the base 100 and focal track layer 202.

FIGS. 20 to 29 are exemplary illustrations of results from different process variables used, including the effect of powder size and distribution, spray distance, chamber pressure, and plasma power to determine optimum method for the production of the anode in accordance with the present invention. Coating cross-sections were prepared by metallographic procedures, and an electrolytic etch of sodium hydroxide was used to reveal the grain structure of the coating. Both optical and scanning electron microscopy was used, and the densities were measured by Archimedes principle on tungsten samples prepared by acid dissolution of the substrate.

Figure 20:
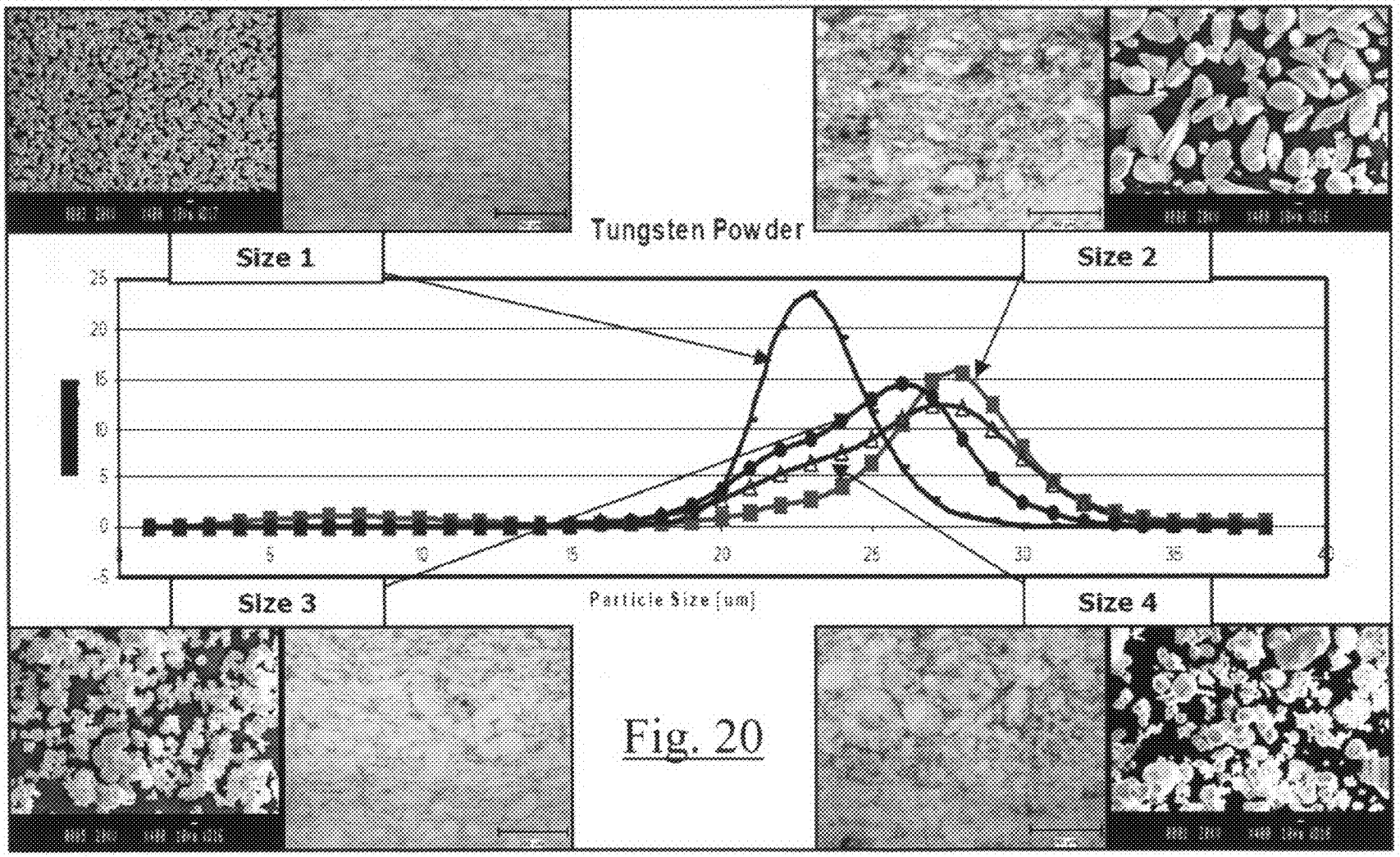
FIG. 20 is an exemplary illustration of tungsten and tungsten alloy powder distribution curves and the corresponding optical micrograph microstructures in accordance with the present invention.

FIG. 20 is an exemplary illustration of tungsten and tungsten alloy powder distribution curves and the corresponding microstructures, and the below table 1 represents the Archimedes density data for the four conditions illustrated in FIG. 20.

TABLE 1

Effect of Particle Size and Distribution on Density of the Focal Track Layer

| | Size 1 | Size 2 | Size 3 | Size 4 |
|---|---|---|---|---|
| Density [%] | 90.6 | 84 | 88 | 87 |

Powders with sizes 2, 3, and 4 are all classified as 5 μm to 45 μm, and size 1 has a range of approximately from 5-26 μm. As illustrated, the finer powder and tighter size distribution resulted in a denser coating structure, and the 5 μm to 45 μm powders all had differing powder morphologies and frequency plots. This variation in powder size and morphology results into a difference in microstructure and density. The densities can be roughly related to the $D_{50}$ of the powder size distribution. In the case of large particles, the presence of larger particles results in a lower melting and packing efficiency reducing the density of the coating for the focal track layer 202.

Figure 21:
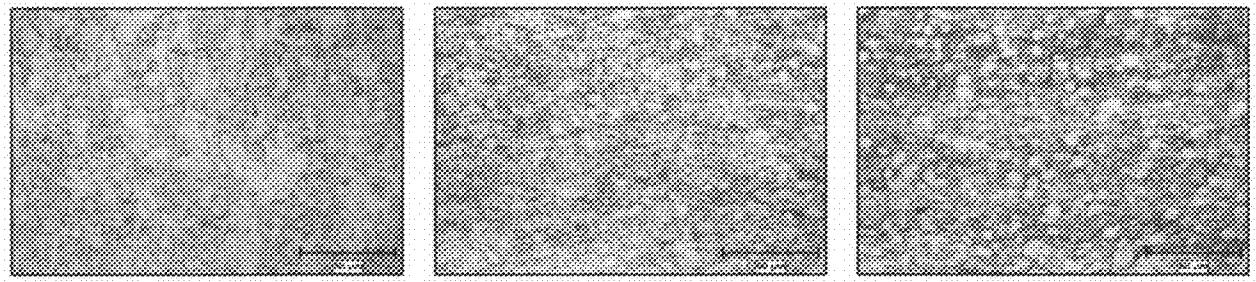
FIG. 21 is an exemplary cross-sectional optical metallographs of the resulting coating using various distances in accordance with the present invention.

FIG. 21 is an exemplary cross-sectional optical metallographs of the resulting coatings using various spraying distances, and table 2 represents densities obtained at those various spray distances. The tungsten and tungsten alloy powder of 5-26 μm was used to spray coatings at 8 kPa (60 Torr) at 150 mm, 250 mm, and 300 mm distance between the base 100 and a single plasma gun (with no auxiliary heating).

TABLE 2

Effect of Spray Distance on Density

| | Distance in [mm] | | |
|---|---|---|---|
| | 150 | 250 | 300 |
| Density [%] | 92.7 | 90.7 | 87 |

As indicated, in accordance with the present invention, improvements in microstructure and density are realized with a decrease in spray distance to 150 mm, and at 300 mm many spherical particles are seen within the structure that resulted from resolidification of the smaller particles during flight. At 250 mm the number of resolidified particles decreases with a subsequent increase in density, and at 150 mm a recrystallized microstructure results with densities approaching 93%. Recrystallization of the splat structure is thought to occur as a result of the contribution of thermal energy from the plasma as the gun is brought closer to the substrate. The recrystallized coatings structure consisted of elongated grains aligned in the direction of heat extraction. Therefore, this establishes the importance of using auxiliary heating to promote recrystallization and subsequent densification of the coding.

Figure 22:
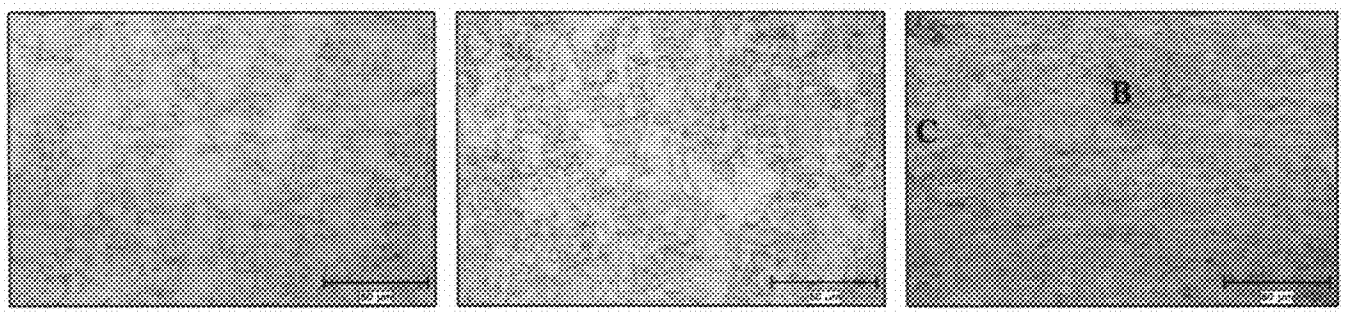
FIG. 22 is an exemplary cross-sectional optical metallographs of the resulting coatings at various pressures in accordance with the present invention.

FIG. 22 is an exemplary cross-sectional optical metallographs of the resulting coatings at various pressures, and table 3 is density data for the various pressures conditions. Coatings were applied at 4 kPa, 8 kPa, and 26 kPa (30 Torr, 60 Torr, and 200 Torr) chamber pressure while maintaining constant power and powder feed rate. Since the plasma stream constricts at higher pressures, the spray distance had to be adjusted to obtain the best coating at a particular pressure.

TABLE 3

Effect of Chamber Pressure on Density

| | Chamber Pressure [kPa] | | |
|---|---|---|---|
| | 4 | 8 | 26 |
| Density [%] | 93.4 | 92.7 | 89.4 |

Figure 23:
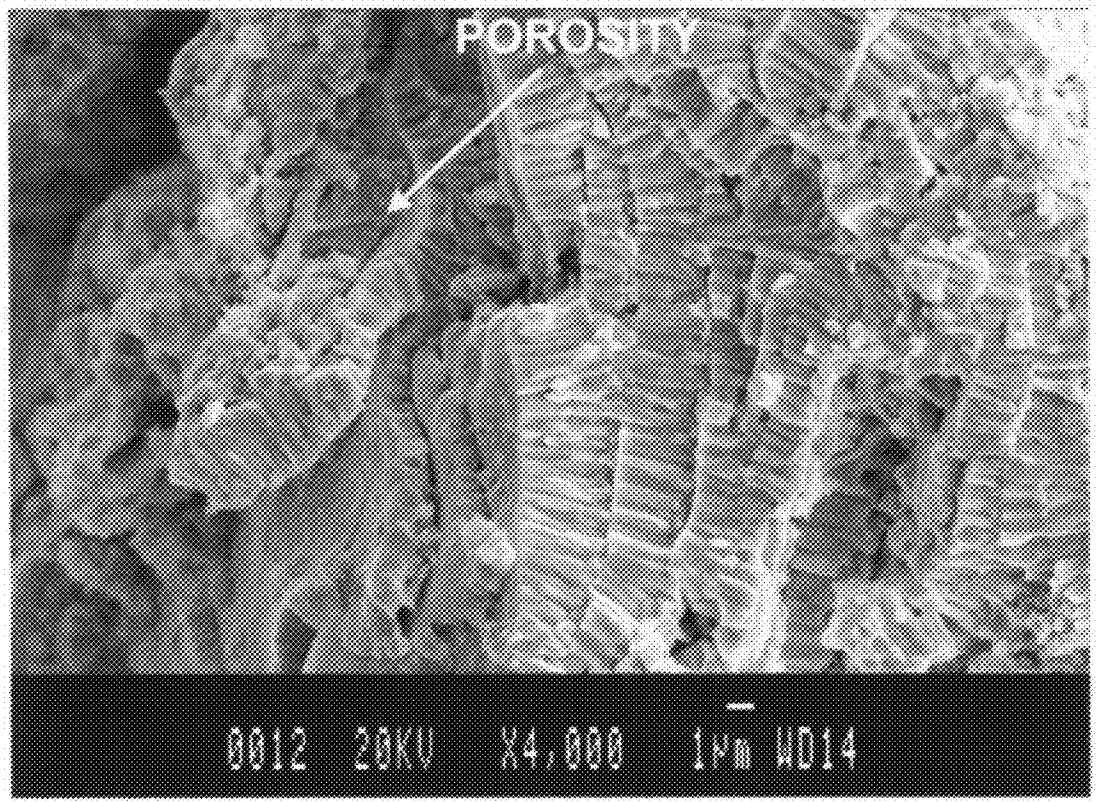
FIG. 23 is an exemplary illustration of a conventional splat like morphology typically observed during conventional LPPS processing.

At both 4 kPa and 8 kPa (30 Torr and 60 Torr), recrystallization of the coating occurs, while a fine splat-like structure is present at 26 kPa (200 Torr). FIG. 23 is an exemplary illustration of a conventional splat like morphology typically observed during LPPS processing. Splat-like structures contain considerable intersplat porosity (FIG. 23), which restricts use where high densities are required, such as the present application. The methodologies in accordance with the present invention provide the ability to obtain a fully recystallized equiaxed grain structure as opposed to the conventional splat like morphology, as illustrated in FIG. 23. It should be noted that although the sample at 26 kPa was applied at the same power level and at an even closer spray distance, the splat structure is still retained. This observation indicates that both high particle velocities and high substrate temperatures are requirements in LPPS to eliminate the splat-like structures and achieve recrystallization. Lower chamber pressures exert less braking forces on the particles therefore higher particle velocities are achieved in these cases, leading to better packing densities and greater ease of surface and grain boundary diffusion.

Figure 24:
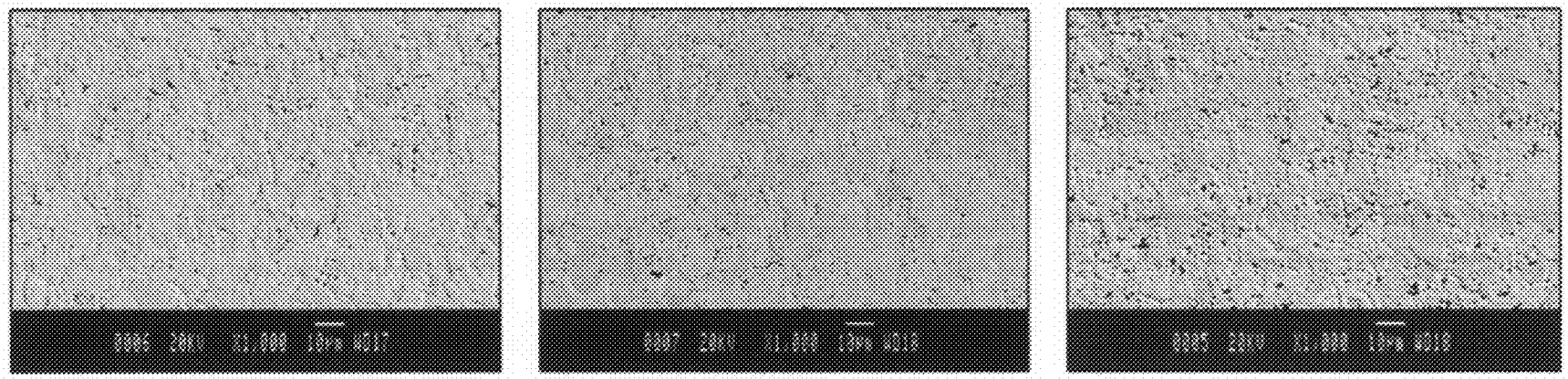
FIG. 24 is an exemplary cross-sectional optical metallographs of the resulting coatings at various power levels in accordance with the present invention.

FIG. 24 is an exemplary cross-sectional optical metallographs of the resulting coatings at various power levels, and table 4 is density data for the various power conditions. In accordance with the present invention, densities of the focal track layer 202 increases with fine particles with tight distribution, high substrate temperatures, and high particle velocities. In accordance with the present invention, power level also effects focal track layer 202 densities. As illustrated in FIG. 24, various density focal track layers were obtained by applying coatings with an even finer particle size ($D_{50}$ below 15 μm) at chamber pressures of 30 Torr and using power levels of 88 kW, 93 kW, and 100 kW. FIG. 24 and Table 4 present the microstructure and density data at these conditions. All cross-sections show a fine equiaxed grain structure with densities comparable to those found in powder sinter-forging. The primary difference between the 3 conditions is the slight increase in grain size and entrapped porosity with an increase in power level. The 88 kW specimen showed fewer pores slightly larger in diameter then the 93 kW specimen that had more pores with smaller diameters. The slight decrease in density of the sample sprayed at 100 kW can be attributed to the higher distribution of larger pores in this specimen. This establishes that based on target size, there is an optimum power level needed to obtain required densities for the focal track.

TABLE 4

Effect of Power on Density

| | Power [kW] | | |
|---|---|---|---|
| | 88 | 93 | 100 |
| Density [%] | 94.5 | 94.5 | 94.4 |

Figure 25B:
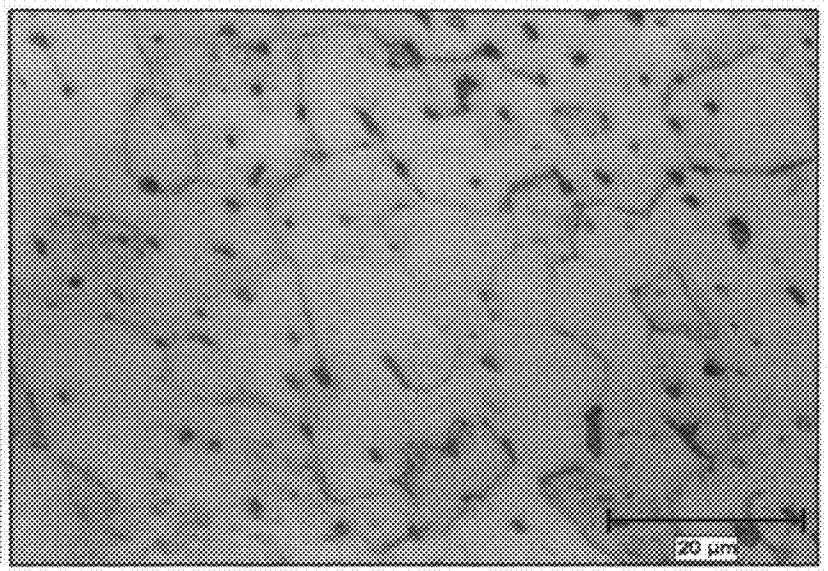
FIG. 25B is an exemplary illustration of a microstrutures of a commercially available sinter-forged Tungsten-5% Rhenium on TZM.
Figure 25A:
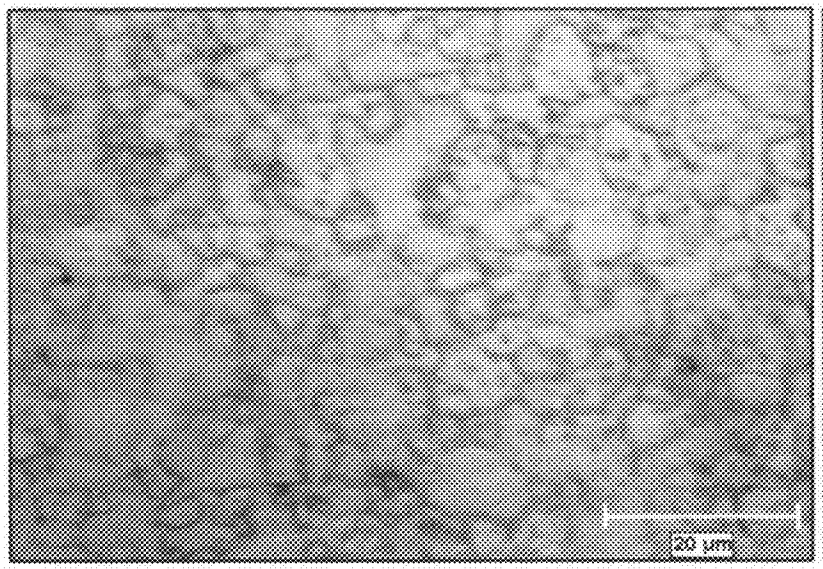
FIG. 25A is an exemplary illustrations of microstructures of a LPPS prepared sample in accordance with the present invention.
Figure 26:
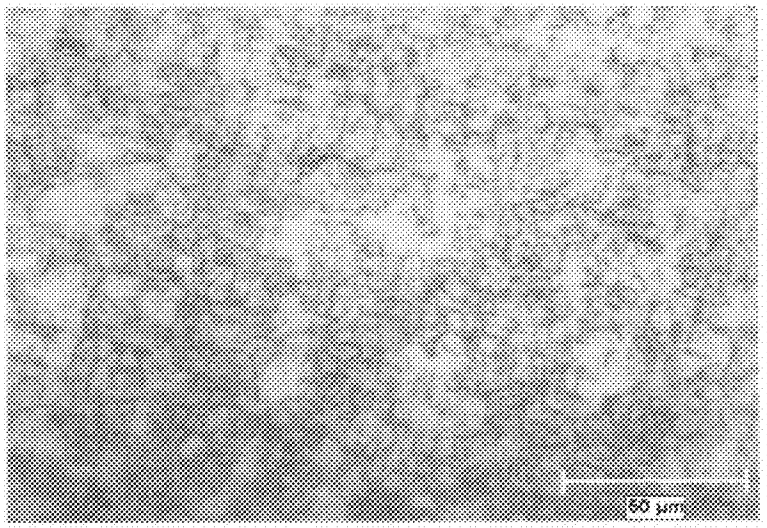
FIG. 26 is an exemplary illustration showing an optical micrograph of tungsten 10% rhenium focal track applied using substrate temperatures of 1000 to 1200° C.

FIGS. 25A and 25B are exemplary illustrations of microstructures of a LPPS prepared sample with similar composition as the sample of commercially available sinter-forged Tungsten-5% Rhenium focal track on TZM, which was mounted and metallographically prepared. As illustrated, the LPPS sample (FIG. 25A) has smaller grain size compared with sinter forged sample (FIG. 25B). Image analysis calculated average grain sizes of 8 μm for the LPPS and 18 μm for sinter forged specimen. The sinter forged specimen also showed much bigger pores then the LPPS sample. The respective densities of the LPPS and the sinter forged specimen are 94.7% and 93.6%. This establishes that LPPS processing can be used for manufacturing of focal tracks.

The large influence of the powder size is a result of the high density of tungsten, which is 19.3 g/cm$^3$. A particle with an equivalent diameter of 10 μm has a mass of $1.01\times10^{-8}$ g whereas a particle with a diameter of 20 μm has a mass of $8.08\times10^{-8}$ g. The heat required to melt a particle can be estimated from $$\boxed{\Delta H = mCp\Delta T} \quad (1)$$

where ΔH is the approximate amount of heat needed to raise the temperature of the particle to its melting point;

m is the mass;

$C_p$ the heat capacity of the spray martial; and

ΔT is the temperature differential between the temperature of the melting point and the ambient temperature;

The ratio of $\Delta H_{20\mu m}\Delta H_{10\mu m}$ results in a value of 8, which means that approximately 8 times more heat is required to raise the temperature of a 20 μm particle to the same level as a 10 μm particle. This is non-trivial when considering the spread in conventional LPPS powder distributions is more then 30 μm (for example, 5 to 45 μM). Furthermore, the powder size and therefore their mass have an effect on the terminal velocities that can be achieved. Heavier particles have slower acceleration and deceleration then lighter particles, and heavier particles also have lower peak velocities. The velocity and size of the particles also determine the packing density in the coatings. Assuming a disc like platelet on impact with diameter D, the coordination number is then 12, the porosity can be roughly approximated in the form of a triangular pie like structure with each side ⅛πD and splat height h, volume of this structure is the area of the equilateral triangle formed multiplied by the splat height $$\boxed{\text{Volume} = (1/2)(1/64)\pi^2 hD^2 \sin(60°)} \quad (2)$$

Again, taking a 20 μm and 10 μm particle and assuming the particle spreads to 4D, h will then be D/24 (from conservation of mass). Substituting for D in equation (2) for the sizes in question leads to interstice porosity of $2.22\times10^{-11}$ cm$^3$ and $2.78\times10^{-12}$ cm$^3$ for the 20 μm and 10 μm sized particles, respectively, which demonstrates the reason for the higher densities of coatings formed from finer powders. That is, an order of magnitude difference in pore size volume occurs when doubling the powder size.

It should be noted that it is much easier to bridge the smaller pores with molten liquid or flow from low viscosity superheated splats from subsequent passes contributing to further density enhancement. It should further be noted that the porosity in FIG. 24 is caused by pore entrapment in grains and along grain boundaries as in classical powder sintering rather then intersplat porosity as in FIG. 23. The techniques established by the present invention illustrate that fine equaixed grains can result using optimum conditions of the process variable listed above, as opposed to conventional splat like structure. It is also relevant that the recrystallized structures obtained by using coarser powder at 150 mm spray distance and 4 kPa (FIG. 22) does not have as high a density as those with equiaxed structures (FIG. 24).

Another important consequence of using finer particles with a very tight distribution is that more uniform heating and increased melting will occur leading to increased densification by viscous flow. In general, with larger particles, there is a tendency to superheat the outer most surfaces of the particles rather than have a uniform temperature throughout the entire mass of the particle. This leads to smaller neck formations between particles, which suggest that lowering the powder size further and increasing their velocity and decreasing the deposit temperature during spraying should limit the grain growth and thereby further increase density. However, it should be noted that temperatures should be always above the recrystallization temperature. Further, equipment considerations such as the powder feeder and nozzle designs also limit the size and velocity that can be achieved. In comparison to sinter-forging the faster heating and cooling cycles in LPPS have the beneficial effect of limiting grain growth and hence pore evolution. As described above, the microstructure of tungsten deposits formed in LPPS is strongly influenced by processing variables. Under tight processing conditions, deposits of tungsten matching the microstructure and density of those found in powder sinter forging can be formed using LPPS. The predominant variable affecting density is powder size and distribution.

Referring back to FIG. 3, after completion of the coating cycle at functional act 320, the plasma guns 1802 and 1804 are turned off so to commence a cooling cycle of the base 100. The cooling cycle includes a second lowering of the chamber pressure upon completion of the low pressure plasma spraying coating cycle to cool the base 100. The second lowering of the chamber 400 pressure reduces the chamber 400 pressure back down to 400 microns and lower, and the base 100 is cooled to an approximate temperature of about 150° C. under such low pressures, completing functional act 322. The cooling of the base 100 may also include using a cooling chamber, which is well-known, with the cooling chamber filled with an inert gas (e.g., argon) and the base 100 moved therein for faster cooling. At functional act 324, after the base 100 is cooled, the chamber 400 is backfilled with inert gases to atmospheric pressure, and the base 100 is removed.

As further illustrated in FIG. 3, the method for production of a rotary anode for X-ray tubes in accordance with the present invention is further comprised of a post-coating heat treatment to stabilize grain structure and provide relief of residual stress, which is indicated at functional act 326. The post-coating heat treatment includes placing the formed anode within a vacuum chamber and reducing a pressure of the vacuum chamber to de-gas the formed anode, and commencing a heat treatment process of the formed anode therein within the vacuum chamber, which allows most remaining void pores therein the focal track layer to consolidate. In general, the vacuum chamber is a well-known heat treatment furnace, where the pressure therein is reduced to approximately $10^{-6}$ micrometers or less. The duration and intensity of the heat treatment is approximately 30 minutes to 2 hours at an approximately temperature of 1600° C., which further dense the focal track layer by an additional 1 to 1.5% of as sprayed density. The Hot Isostatic Pressing (HIP) treatment provides an additional 4% or more density.

It should be noted that post coating heat treatment is conducted for relief of residual stresses and elimination of porosity. If a lamellar structure or mixed equiaxed/lamellar is present in the coatings with a density of 92-93% of theoretical, vacuum heat-treatment from 1600° C. to 1800° C. will only increase density to 95% even though an equiaxed structure is formed. For high performance x-ray target focal track layers, these densities are insufficient. However, when substrate temperatures of over 1300° C. are maintained, then densities of 96-97% are present. Nonetheless, in accordance with the present invention, vacuum heat treatment at 1600° C. provides densities of 98%. Densities of 98% and above are desired for x-ray target focal tracks. An effective method of improving densities from 93% to 99% of theoretical is to use a preliminary heat treat at 1600-1700° C. from approximately 30 minutes to about 4 hours followed by Hot Isostatic Pressing in argon at 28,000 psi and at 1500-1800° C. for 1-2 hours. The Hot Isostatic Process (HIP) is well established as a process for effecting densification in casting of refractory metals.

As a further component of the functional act 326, the anode is further densified by commencing one of hot isostatic pressing, hot forging, and pseudo hot isostatic pressing of the anode in accordance with the present invention. Any of the mentioned processes further squeeze out most of the remaining pores using pressure and heat, so long as the pores are on the grain boundary. In general, as indicated above, pores originate from particles joined together. In general, most of the porosity is eliminated in the first hour of treatment and the optimum grain structure is achieved during the extended period of time and hence, further densification is achieved by relief of residual stress and elimination of porosity. The heat treatments are based on the alloy used for manufacture, with the temperature ranges from 1500 to 1800° C. from times of 30 minutes to 8 hours, and pressures of 200-300 psi are used with the preferred heat treat environment being in a vacuum. Hot Isostatic Pressing or other densification treatments such as spark sintering or hot forging can be performed from 1500 to 1800° C. dependant on the molybdenum alloy chosen for the anode base.

The hot isostatic pressing, which is well-known, in accordance with the present invention includes heat treatment of the formed anode within a Hot Isostatic Pressing (HIP) chamber, under an increased chamber pressure by introducing an inert gas therein while maintain the heat treatment process. The inert gas introduced within the HIP chamber is comprised of hydrogen to form a protective environment, with the duration of the hot isostatic pressing lasting from approximately 1 to about 2 hours, under approximate pressure of about 15,000 psi to 28,000 psi, at a temperature of approximately 1500° C. to 1800° C., which results in an anode having a theoretical density of 98% upwards. Hot forging is a well-know process, and in accordance with the present invention is conducted using a press that has a heated die upon which the heated (at approximately 1500° C.) anode is forged by means of a strike mechanism, such as a hammer. With Pseudo hot isostatic pressing (HIP) the formed anode is placed under a hydraulic press that is within a heated chamber, surrounded by pressure transfer media, such as one of spherical graphite and boron nitride. The pressure transfer media are mere fillers that fill the void space between the anode, the chamber walls, and the hydraulic press, which allows equal pressure to be transferred equally to all parts of the anode. Stated otherwise, conventional hot press is converted to a pseudo hot isostatic pressing (HIP) press by means of inserting a pressure transfer media such as one of spherical graphite and boron nitride into the die cavity. It should be noted that conventional hot presses provide a uni-axial press, whereas the pseudo HIP provides a multi-axial press against the anode body, which provides a more uniform pressure.

The method for production of a rotary anode for X-ray tubes in accordance with the present invention further includes grinding the focal track layer of the anode using diamond grinding wheels to form an appropriate angle of focal track layer, and application of a super finishing process using vibratory diamond belts to achieve finishes of approximately 4 micro-inches and less (preferably 2 micro-inches). The super finishing process removes the grind marks, which are the starting point of cracks during radiation of the focal track layer. In general, the super finish process includes vibratory polishing the grinded-off anode to polish off the grind marks.

EXAMPLE 1

Base 100 used was a 4"¾" thick TZM disc
First lowering of pressure at 400 micron vacuum
Backfill with argon to 30 Torr
Negative Transferred Arc Sputter Clean at 10" 2 KW
Heat disc to above 1400° C.
Deposit Tungsten 5% Rhenium Powder at 43 gr/min
Helium 200 psi at 300 SCFH
Argon 150 psi at 200 SCFH (functional acts 310 and 320 of FIG. 3)
Plasma arc power of 100-112 KW
Total Time of coating cycle 7 minutes
Total thickness of focal track 0.052"

Figure 27:
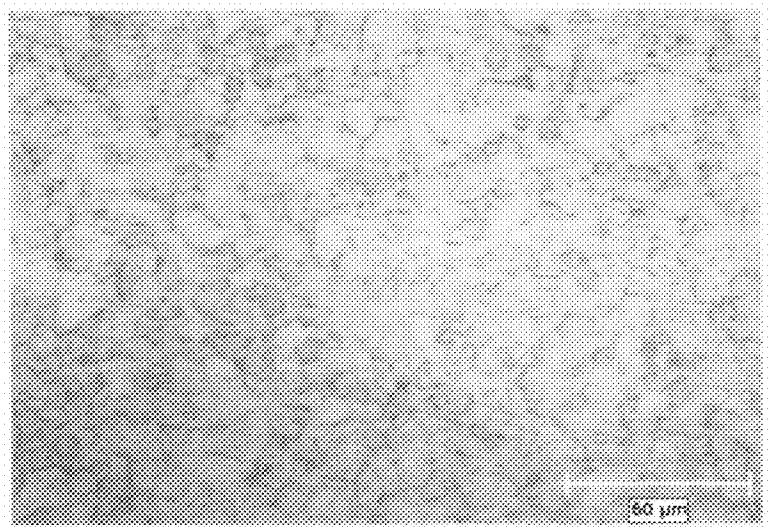
FIG. 27 is an exemplary illustration showing an optical micrograph of tungsten 5% rhenium focal track applied using substrate temperatures above 1300° C.

The coating structure is shown in FIG. 27. An equiaxed structure with a grain size of 10-20 microns was generated. The density of the coating measured using Archimedes technique is 96.5% of theoretical heat treatment in vacuum at 1600° C. for approximately 1-4 hours lead to densities of 97.5% without altering substantially the grain size.

EXAMPLE 2

Base used was 8" TZM disc ¾" thick
Coating material Tungsten 10% Rhenium

Figure 28:
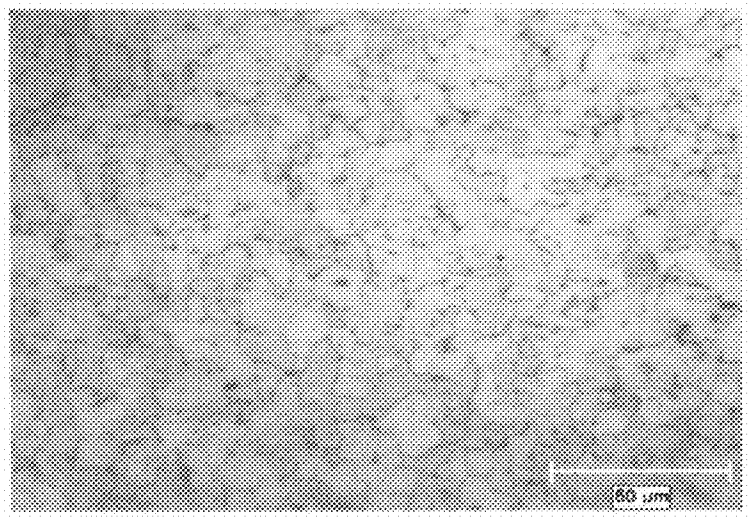
FIG. 28 is an exemplary illustration showing an optical micrograph of tungsten 10% rhenium focal track that is heat treated.
Figure 29:
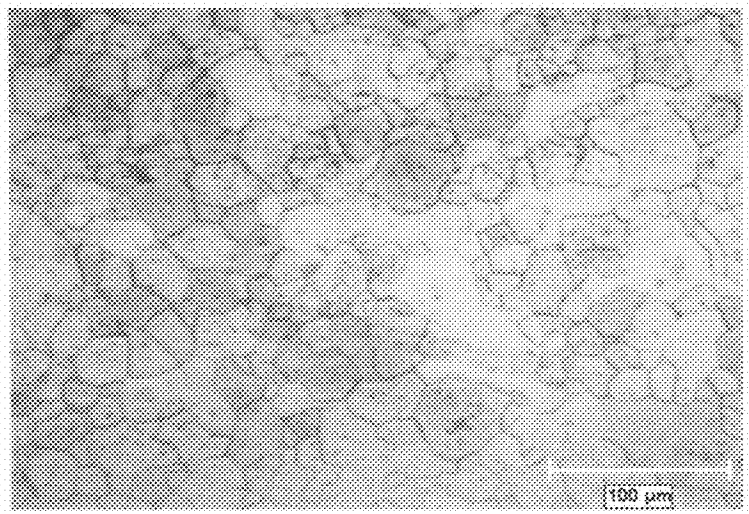
FIG. 29 is an exemplary illustration showing optical micrograph of tungsten 10% rhenium focal track that is hot isostatic pressed.

Similar parameters as example 1 were used with the exception that the substrate temperature during deposition was maintained at 1200° C. and the deposition time was extended to 17 minutes to accommodate the larger area to be coated. The coating structure obtained is that of FIG. 26 which shows partial recystallization of the coating particles as they form the coating. The piece was heat treated at 1700° C. for approximately 4 hours and Hot Isostatic Pressed (HIP) at 28,000 psi, 1800° C. for about 4 hours. The resulting structure after heat treatment at 1700° C. is shown in FIG. 28. The after heat treat the grains were equiaxed and measured from 10-20 microns. The structure after HIP is shown in FIG. 29. The equiaxed grains measured from between 20-45 microns. The density of the HIPPED structure was found to be at a 98.5% minimum.

Although the invention has been described in considerable detail in language specific to structural features and or method acts, it is to be understood that the invention defined in the appended claims is not necessarily limited to the specific features or acts described. Rather, the specific features and acts are disclosed as preferred forms of implementing the claimed invention. Stated otherwise, it is to be understood that the phraseology and terminology employed herein, as well as the abstract, are for the purpose of description and should not be regarded as limiting. Therefore, while exemplary illustrative embodiments of the invention have been described, numerous variations and alternative embodiments will occur to those skilled in the art. For example, the dimensions of the base may vary. As other examples, the plasma gas mixture may be varied, ceramic insulation material may vary so long as no contamination occurs when the insulation material used contacts with the anode body. The plasma gun to anode distance may also be varied by +/−2 inches, and the gun powder and powder feed rate may be varied. Of course, all variations depend on many factors, non-limiting, non-exhaustive listing of examples of which may include particle size, the level of densities of the focal track desired, and so on. Such variations and alternate embodiments are contemplated, and can be made without departing from the spirit and scope of the invention.

It should further be noted that throughout the entire disclosure, the labels such as left, right, front, back, top, bottom, forward, reverse, clockwise, counter clockwise, up, down, or other similar terms such as upper, lower, aft, fore, vertical, horizontal, proximal, distal, etc. have been used for convenience purposes only and are not intended to imply any particular fixed direction or orientation. Instead, they are used to reflect relative locations and/or directions/orientations between various portions of an object.

In addition, reference to "first," "second," "third," and etc. members throughout the disclosure (and in particular, claims) is not used to show a serial or numerical limitation but instead is used to distinguish or identify the various members of the group.

In addition, any element in a claim that does not explicitly state "means for" performing a specified function, or "step for" performing a specific function, is not to be interpreted as a "means" or "step" clause as specified in 35 U.S.C. Section 112, Paragraph 6. In particular, the use of "step of," "act of," "operation of," or "operational act of" in the claims herein is not intended to invoke the provisions of 35 U.S.C. 112, Paragraph 6.

What is claimed is:

1. A method for the production of a rotary anode for X-ray tubes, comprising:
- providing a base;
- pre-heating the base;
- using low pressure plasma to spray material as a focal track layer on to the base, including use of at least one plasma gun and one or more auxiliary heating sources to maintain even heating of the base and to retain a desired temperature of the base during the low pressure plasma spray.

2. The method for production of a rotary anode for X-ray tubes as set forth in claim 1, wherein:
- the material is selected from the group consisting of tungsten, tungsten alloys, and combinations thereof.

3. The method for production of a rotary anode for X-ray tubes as set forth in claim 2, wherein:
- tungsten alloy is comprised of tungsten rhenium alloys comprising of rhenium from 3.5 wt % up to a solubility limit in the tungsten.

4. The method for production of a rotary anode for X-ray tubes as set forth in claim 3, wherein:
- the rhenium content is 5 to 10 wt %.

5. The method for production of a rotary anode for X-ray tubes as set forth in claim 2, wherein:
- the tungsten and the tungsten alloy are comprised of a de-agglomerated tungsten powder, with a mean powder particle size ranging from approximately 2 micrometers to about 15 micrometers, with a $D_{50}$ of 8 to 10 micrometers.

6. The method for production of a rotary anode for X-ray tubes as set forth in claim 5, wherein:
- the one or more auxiliary heating sources are comprised of plasma guns.

7. The method for production of a rotary anode for X-ray tubes as set forth in claim 6, wherein:
- the low pressure plasma spraying of tungsten alloy as a focal track layer onto the base is comprised of:
- placing the base within a chamber;
- masking areas of the base adjacent the focal track to shield the areas from tungsten alloy spray deposits;
- a first lowering of the chamber pressure for removal of gases;
- introducing a low pressure inert gas into the chamber for forming a protective environment;
- igniting the plasma guns inside the chamber;
- cleaning the base for removal of oxides and dirt;
- further de-agglomerating the de-agglomerated tungsten alloy powder;
- preheating the base for commencing a low pressure plasma spraying coating cycle;
- pouring the further de-agglomerated tungsten alloy powder into one of the plasma guns for depositing thereof onto the base;
- commencing the low pressure plasma spraying coating cycle of the base to desired coating thickness using one of the plasma guns, and maintaining even heating of the base using one of other plasma gun and heat source;
- a second lowering of the chamber pressure upon completion of the low pressure plasma spraying coating cycle, cooling the base, filling the chamber with gas to atmospheric pressure, and removing the base.

8. The method for production of a rotary anode for X-ray tubes as set forth in claim 7, wherein:

the base is placed onto a self-aligning fixture that aligns the base with an axial centerline of a turntable that is located within the chamber, with the turntable effecting an axial rotation and translational movement of the base via computer control within the chamber.

9. The method for production of a rotary anode for X-ray tubes as set forth in claim 8, wherein:

the self-aligning fixture is comprised of high temperature molybdenum alloys, having three independent components locked and centered by the use of molybdenum eccentric pin that lock in the base alloy thereon, and align base with the central axis of the turntable;

the turntable is comprised of an insulating platform allowing the base to rest thereon, and preventing heat conduction from the anode into the turntable; and the rotation is effected by a drive mechanism, and the axial translation is effected by servo control of a shaft that moves turntable.

10. The method for production of a rotary anode for X-ray tubes as set forth in claim 8, wherein:

the mask is coupled with the self-aligning fixture by a locking mechanism for quickly and easily locking and releasing the base and preventing the base from wobbling when locked.

11. The method for production of a rotary anode for X-ray tubes as set forth in claim 7, wherein:

a movement of the plasma guns inside the chamber is vertical in relation to the base.

12. The method for production of a rotary anode for X-ray tubes as set forth in claim 7, wherein:

the control of pressure of the chamber, motion of the plasma guns, and a rotary and translational axis of the base alloy are controlled by a computer.

13. The method for production of a rotary anode for X-ray tubes as set forth in claim 7, wherein:

the inert gases introduced into the chamber is comprised of argon and helium, and is set to increase the chamber pressure to an approximate pressure of 5 to 60 torr.

14. The method for production of a rotary anode for X-ray tubes as set forth in claim 7, wherein:

the cleaning of the base includes using negative reverse transferred arc using one or more plasma guns.

15. The method for production of a rotary anode for X-ray tubes as set forth in claim 14, wherein:

negative reverse transferred arc further comprises:

providing a supplemental power supply coupled with at least one of the plasma guns to form a bias from an anode of the selected plasma gun to the base alloy, which when ignited, creates arcing and removes and pulls off surface oxides and dirt from a surface of the base.

16. The method for production of a rotary anode for X-ray tubes as set forth in claim 15, wherein:

a duration of cleaning lasts approximately from about 60 to 90 seconds, with a power input of approximately 20 KW.

17. The method for production of a rotary anode for X-ray tubes as set forth in claim 7, wherein:

further de-agglomerating process, includes:

heating the de-agglomerated tungsten alloy powder to an approximate temperature of about 38° C. to remove moisture.

18. The method for production of a rotary anode for X-ray tubes as set forth in claim 7, wherein:

further de-agglomerating process, includes:

vibrating the de-agglomerated tungsten alloy powder for time to eliminate electrostatic charges, preventing static agglomeration of the particles.

19. The method for production of a rotary anode for X-ray tubes as set forth in claim 7, wherein:

the duration of preheating the base to a minimum of 1300° C. and higher is approximately 3 to about 4 minutes, which allows for re-crystallization of equiaxed grain of the tungsten alloy particles deposited onto the base as the focal track using the plasma guns.

20. The method for production of a rotary anode for X-ray tubes as set forth in claim 7, wherein:

the duration of the coating cycle is approximately 16 minutes, and is comprised of moving the base under the plasma guns through the rotational and translational motion of the base.

21. The method for production of a rotary anode for X-ray tubes as set forth in claim 7, wherein:

the base is cooled to an approximate temperature of about 150° C.

22. The method for production of a rotary anode for X-ray tubes as set forth in claim 7, wherein:

cooling the base includes using a cooling chamber, with the cooling chamber filled with an inert gas and the base moved therein for faster cooling.

23. The method for production of a rotary anode for X-ray tubes as set forth in claim 22, wherein:

the inert gas is comprised of argon.

24. The method for production of a rotary anode for X-ray tubes as set forth in claim 7, further comprising:

a post-coating beat treatment to stabilize grain structure and provide relief of residual stress.

25. The method for production of a rotary anode for X-ray tubes as set forth in claim 24, wherein:

post-coating heat treatment includes:

placing the formed anode within a vacuum chamber and reducing a pressure of the vacuum chamber to de-gas the formed anode, and commencing a heat treatment process of the formed anode therein within the vacuum chamber, which allows the void pores therein the focal track to consolidate.

26. The method for production of a rotary anode for X-ray tubes as set forth in claim 23, wherein:

the vacuum chamber is a vacuum heat treatment furnace.

27. The method for production of a rotary anode for X-ray tubes as set forth in claim 25, wherein:

the duration and intensity of the heat treatment is approximately 30 minutes to 2 hours at an approximately temperature of 1600° C., which further dense the focal track by an additional 1 to 1.5% of as sprayed density.

28. The method for production of a rotary anode for X-ray tubes as set forth in claim 25, further comprising:

further densification of the formed anode by commencing one of hot isostatic pressing, hot forging, and pseudo hot isostatic pressing of the anode.

29. The method for production of a rotary anode for X-ray tubes as set forth in claim 28, wherein:

the hot isostatic pressing includes:

heat treatment of the formed anode under an increased chamber pressure by introducing an inert gas therein while maintain the heat treatment process.

30. The method for production of a rotary anode for X-ray tubes as set forth in claim 29, wherein:

the inert gas is comprised of argon to form a protective environment, with the duration of the hot isostatic pressing lasting from approximately 1 to about 2 hours, under approximate pressure of about 15,000 psi to 28,000 psi, at a temperature of approximately 1500° C. to 1800° C., which results in an anode having a theoretical density of 98% of theoretical and upwards.

31. The method for production of a rotary anode for X-ray tubes as set forth in claim 7, further comprising;

grinding the focal track layer using diamond grinding wheel to form an appropriate angle of focal track layer; and application of a super finishing process using diamond belts to achieve finishes of approximately 4 micro-inches and less.

32. The method for production of a rotary anode for X-ray tubes as set forth in claim 31, wherein:

the super finish process includes vibratory polishing the grinded-off anode to polish off the grind marks.

33. The method for production of a rotary anode for X-ray tubes as set forth in claim 7, wherein:

the particle velocity is approximately 200 m/sec or more within the plasma flow prior to impingement onto the base.

34. The method for production of a rotary anode for X-ray tubes as set forth in claim 7, wherein:

the pressure within the chamber is modified by pumps.

35. The method for the production of a rotary anode for X-ray tubes as set forth in claim 1, wherein:

the base is comprised of an alloy with primary constituent comprised of molybdenum.

36. The method for the production of a rotary anode for X-ray tubes as set forth in claim 35, wherein:

the base alloy is comprised of one of Titanium-Zirconium-Molybdenum (TZM) alloy, Oxide dispersion strengthen Molybdenum alloy, Carbide dispersion strengthen Molybdenum alloy, Boride dispersion strengthen Molybdenum, and Niobium-tungsten Molybdenum alloy.

37. The method for the production of a rotary anode for X-ray tubes as set forth in claim 35, wherein:

the base alloy is manufactured using one of a powder metallurgical techniques and arc melting, followed by one of forging and rolling.

* * * * *